US006855014B2

(12) United States Patent
Kinoshita et al.

(10) Patent No.: US 6,855,014 B2
(45) Date of Patent: Feb. 15, 2005

(54) CONTROL FOR WATERCRAFT PROPULSION SYSTEM

(75) Inventors: Yoshimasa Kinoshita, Shizuoka (JP); Kazumasa Ito, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/624,111

(22) Filed: Jul. 21, 2003

(65) Prior Publication Data

US 2004/0087222 A1 May 6, 2004

Related U.S. Application Data

(60) Provisional application No. 60/402,825, filed on Aug. 9, 2002.

(30) Foreign Application Priority Data

Jul. 19, 2002 (JP) ..... 2002-211504

(51) Int. Cl.[7] ..... B63H 21/22

(52) U.S. Cl. ..... 440/1; 440/87

(58) Field of Search ..... 440/1, 87, 84

(56) References Cited

U.S. PATENT DOCUMENTS

| | | | | |
|---|---|---|---|---|
| 4,850,318 A | * | 7/1989 | Torigai et al. | 123/352 |
| 6,119,653 A | | 9/2000 | Morikami | |
| 6,223,723 B1 | * | 5/2001 | Ito | 123/406.51 |
| 6,231,410 B1 | | 5/2001 | Bernier et al. | |
| 6,336,833 B1 | | 1/2002 | Rheault et al. | |
| 6,390,862 B1 | | 5/2002 | Eichinger | |
| 6,428,371 B1 | * | 8/2002 | Michel et al. | 440/38 |

* cited by examiner

*Primary Examiner*—Stephen Avila
(74) *Attorney, Agent, or Firm*—Knobbe, Martens, Olson & Bear, LLP

(57) ABSTRACT

An engine output control device is configured to detect an actual engine speed and to determine a modified engine speed based on the actual engine speed that is more in proportion to the speed of the watercraft than the actual engine speed. The modified engine speed can be used to control the output of the engine so as to provide a more natural feeling for the operator of the watercraft. The modified engine speed can also be used as an indication of the speed of the watercraft. As such, the modified engine speed can also be used to determine the extent to which the output of the engine can be raised to provide additional thrust for steering purposes.

26 Claims, 18 Drawing Sheets

CONTROL FOR WATERCRAFT PROPULSION SYSTEM

The present application is based on and claims priority to Japanese Patent Application No. 2002-211504 filed Jul. 19, 2002, and U.S. Provisional Application No. 60/402,825 filed on Aug. 9, 2002, the entire contents of which are hereby expressly incorporated by reference.

BACKGROUND OF THE INVENTION

1. Field of the Invention

The present application relates to a control system for an engine of a watercraft, and in particular, to a control system which relates to engine operation of a watercraft during turning.

2. Description of the Related Art

Personal watercraft have become very popular in recent years. This type of watercraft is quite sporting in nature and carries one or more riders. A hull of the personal watercraft commonly defines a rider's area above an engine compartment. An internal combustion engine powers a jet propulsion unit that propels the watercraft by discharging water rearwardly. The engine lies within the engine compartment in front of a tunnel, which is formed on an underside of the hull. The jet propulsion unit is placed within the tunnel and includes an impeller that is driven by the engine.

A deflector or turning nozzle is mounted on the rear end of the jet propulsion unit for steering the watercraft. A steering mast with a handlebar is linked with the deflector through a linkage. The steering mast extends upwardly in front of the rider's area. The rider remotely steers the watercraft using the handlebar.

The engine typically includes a throttle valve disposed in an air intake passage of the engine. The throttle valve regulates the amount of air supplied to the engine. Typically, as the amount of air increases the engine output also increases. A throttle lever control is attached to the handlebar and is linked with the throttle valve usually through a throttle linkage and cable. The rider thus can control the throttle valve remotely by operating the throttle lever on the handlebar.

When the throttle is released, the natural feeling of on-throttle turning can change and make the rider uncomfortable while maneuvering the watercraft. It is desirable to maintain a comfortable feeling while making both on-throttle and off-throttle maneuvers.

SUMMARY OF THE INVENTION

One aspect of at least one of the inventions disclosed herein includes the realization that a modified engine speed value can be more in proportion to the watercraft speed than actual engine speed, and thus provide an approximately proportional indicator of watercraft speed, under at least some circumstances. For example, an engine speed value can be modified such that the value of the modified engine speed value changes more slowly than the actual engine speed. Similarly, the watercraft speed, during positive and negative acceleration, changes more slowly than can the engine speed. Thus, the engine speed itself can be used as a basis for estimating watercraft speed for engine control operations, thereby avoiding the use of a sensor that directly detects watercraft speed. This is advantageous because water speed sensors are prone to clogging and damage because they are in contact with the water in which the watercraft operates.

In accordance with another aspect of at least one of the inventions disclosed herein, a watercraft comprises a hull, an engine supported by the hull, and a propulsion request device configured to allow an operator to input a propulsion request. A propulsion device is supported by the hull and is driven by the engine. An engine speed sensor is configured to detect an actual speed of the engine. A controller is configured to communicate with the propulsion request device and to affect a power output of the engine based on an output of the propulsion request device and a speed of the engine. The controller is configured to determine an actual engine speed value of the engine based on the output of the engine speed sensor and a modified engine speed value, based on the output of the engine speed sensor. The modified engine speed value is configured to change more slowly than the actual speed of the engine.

In accordance with yet another aspect of at least one of the inventions disclosed herein a method of controlling an engine of a watercraft is provided. The method comprises detecting a propulsion request from an operator of the watercraft, detecting an actual speed of the engine, controlling a power output of the engine based on the detected actual speed of the engine and based on the propulsion request. Additionally, the method includes determining a modified engine speed value such that the modified engine speed value changes more slowly than the detected engine speed.

In accordance with a further aspect of at least one of the inventions disclosed herein, a watercraft comprises a hull, an engine supported by the hull, and a propulsion request device configured to allow an operator to input a propulsion request and configured to emit a propulsion request output. A controller is configured to determine if the propulsion request output changes abruptly from a first value to a second lower value. The controller is also configured to lower the engine speed at a first rate slower than a rate at which the propulsion request output abruptly changed. The watercraft also includes a steering mechanism and a steering sensor connected to the controller. The controller is further configured to lower the engine speed at a second rate that is lower than the first rate.

In accordance with an additional aspect of at least one of the inventions disclosed herein, a watercraft comprises a hull, an engine supported by the hull, and a propulsion input device configured to allow an operator to direct a propulsion request to the engine. A propulsion device is supported by the hull and is driven by the engine. A controller is configured to affect a power output of the engine. A sensor is configured to detect a speed of the engine. A steering mechanism is configured to allow an operator of the watercraft to change a direction of travel of the watercraft. A sensor is configured to detect a position of the steering mechanism. The controller is configured to increase a power output of the engine to an elevated power output level that is beyond a power output corresponding to the output of the propulsion request input device if the steering mechanism is moved to a position indicating an operator's desire to change a direction of travel of the watercraft. The controller also is configured to terminate the increase in power output after a delay after the engine speed falls below a predetermined engine speed, In accordance with another aspect of at least one of the inventions disclosed herein, a method of providing additional steering force for a watercraft is provided. The method includes detecting a propulsion request from an operator of the watercraft, detecting a steering direction request from the operator of the watercraft, and detecting a speed of an engine of the watercraft. The method also includes increasing a power output of the engine to an elevated power output level that is greater than the power output level corresponding to the propulsion request, and returning the power output of the engine to the level corresponding to the propulsion request after a delay after the engine speed falls below a predetermined engine speed value.

Another aspect of the least one in the inventions disclosed herein includes the realization that a comparison of a modified engine speed value and an actual engine speed value can be used as an indication that the watercraft is not being operated in water. For example, as is also noted above, a modified engine speed value can be configured to change more slowly than an actual engine speed value. Additionally, such a modified engine speed can be configured to change approximately proportionally to the corresponding watercraft speed, when the watercraft is operating normally in a body of water. Under such normal operation, the engine is loaded, which causes the engine to change speed more slowly than when the engine is completely unloaded (when the watercraft is out of the water).

When such a modified engine speed value is compared to the actual engine speed, and when the watercraft is operating normally in water, at least one relationship becomes apparent. For example, the ratio of the actual engine speed to the modified engine speed value, during acceleration, remains below a threshold value.

BRIEF DESCRIPTION OF THE DRAWINGS

These and other features, aspects, and advantages of the present invention will be described with reference to the drawings of preferred embodiments, which are intended to illustrate and not to limit the invention. The drawings comprise 18 figures.

DETAILED DESCRIPTION OF THE PREFERRED EMBODIMENT

Figure 1:
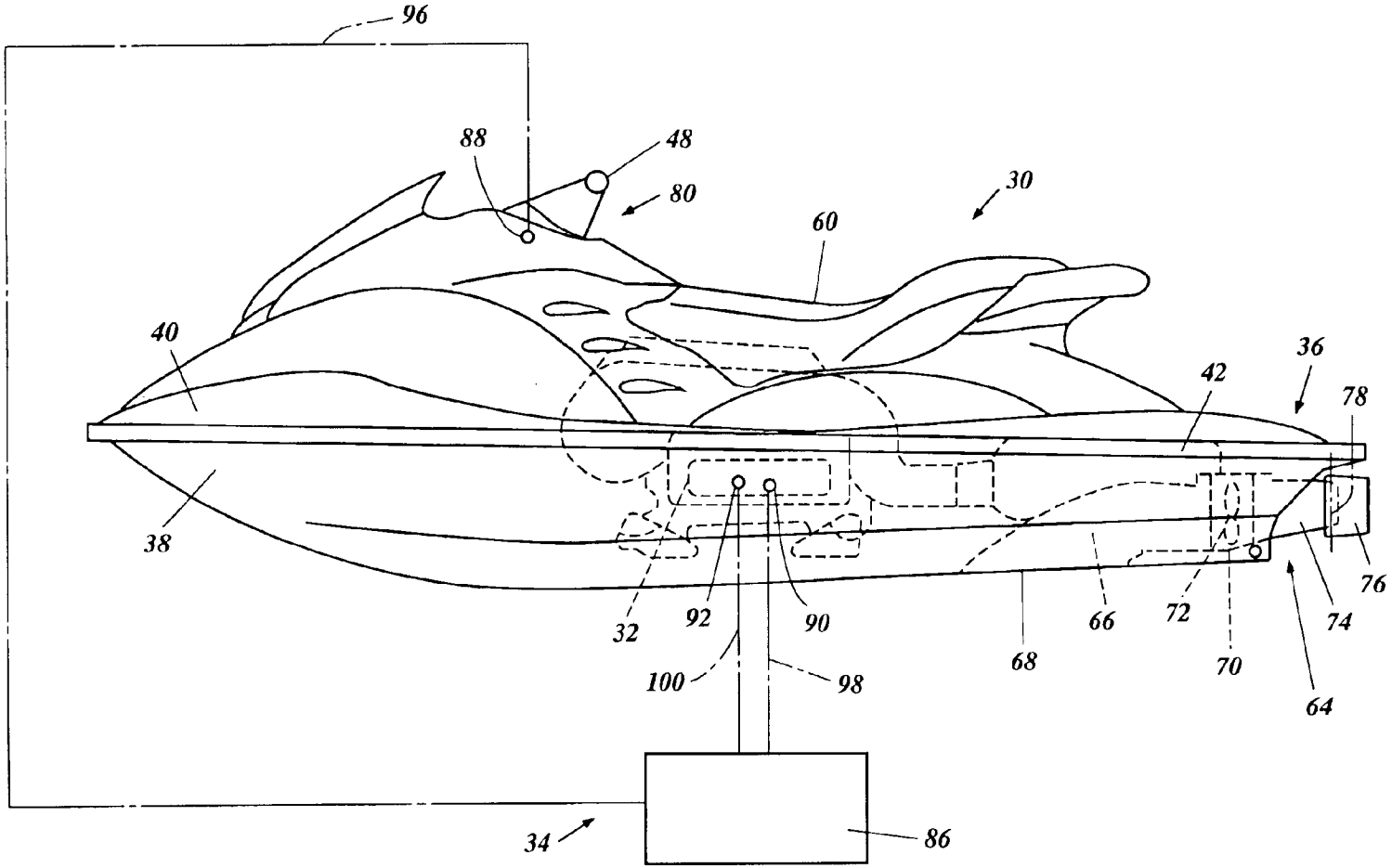
FIG. 1 is a side elevational view of a personal watercraft having a handlebar and a partial schematic illustration of an engine control system configured in accordance with an embodiment of at least one of the inventions disclosed herein. An engine and a propulsion unit are shown in phantom.

With primary reference to FIG. 1 and additionally to FIGS. 2 and 3, an overall configuration of a personal watercraft 30 is described below. The watercraft 30 employs an internal combustion engine 32 and an engine control system 34 configured in accordance with an embodiment of at least one of the inventions disclosed herein. This engine control system 34 has particular utility with a personal watercraft, and thus is described in the context of the personal watercraft 30. The control system however can be applied to other vehicles such as, for example small jet boats.

The personal watercraft 30 includes hull 36 having a lower hull section 38 and an upper hull section or deck 40. The lower hull section 38 can include one or more inner liner sections to strengthen the hull or to provide mounting platforms for various internal components of the watercraft. The hull sections 38 and 40 are made of, for example, a molded fiberglass reinforced resin or a sheet molding compound. The lower hull section 38 and the upper hull section 40 are coupled together to define an internal cavity. A bond flange 42 is defined at an intersection of the hull sections 38, 40.

A steering mast 46 (FIG. 2) extends generally upwardly almost atop the upper hull section 40 to support a handlebar 48. The handlebar 48 is used by the rider for steering control of the watercraft 30. The handlebar 48 also carries other control devices such as, for example, an engine stop switch 50 for turning the engine off and a power output request device or a "propulsion request device". In the illustrated embodiment the power output request device or propulsion request device is a throttle lever 52 for manually operating throttle valves 54 (FIG. 3) of the engine 32. Optionally other configurations of engine output request device can be used depending on the fuel supply system used.

A seat 60 extends longitudinally fore to aft along the centerline of the hull 36 at a location behind the steering mast 46. The seat 60 has generally a saddle shape so that the rider can straddle it. Foot areas (not shown) are defined on both sides of the seat 60 and on an upwardly facing surface of upper hull section 40. The seat 60 is detachably attached to a pedestal portion of the upper hull section 40.

An access opening (not shown) is defined on the top surface of the pedestal, under the seat 60, through which the rider can access the engine compartment defined in an internal cavity formed between the lower and upper hull sections 38, 40. The engine 32 is placed in the engine compartment. The engine compartment may be an area with in the internal cavity or may be divided for one or more other areas of internal cavity by one or more bulkheads.

A fuel tank (not shown) is placed in the cavity under the upper hull section 40 and preferably in front of the engine. The fuel tank is coupled with a fuel inlet port positioned at the top surface of the upper hull section 40 through a filler duct. A closure cap closes the fuel inlet port.

Preferably a pair of air ducts (not shown) is provided, one duct on each side of the upper hull section 40 so that the ambient air can enter the internal cavity through the ducts. Except for the air ducts, the hull is substantially water tight so as to protect the engine 32 and fuel supply system from contact with water.

A jet propulsion unit 64 propels the watercraft 30. The jet propulsion unit 64 includes a tunnel 66 formed on the underside of the lower hull section 38. In some hull designs, the tunnel is isolated from the engine compartment by a bulkhead. The tunnel 66 has a downward facing inlet port 68 that is in fluid communication with the body of water.

The jet pump housing 70 is disposed in the tunnel 66 and in communication with the inlet port 68. An impeller 72 is rotatably supported in the housing 70. An impeller shaft (not shown) extends forwardly from the impeller 72 and is coupled with a crankshaft of the engine 32 so as to be driven by the crankshaft.

The rear end of the housing 70 defines a discharge nozzle 74. A deflector or steering nozzle 76 is affixed to the discharge nozzle 74 for a pivotal movement about a steering axis 78 extending generally vertically. A cable connects the deflector 76 with the steering mast 46 so that the rider can pivot the deflector 76 thereby and steer the watercraft 30. A steering mechanism 80 for the watercraft thus preferably comprises the steering mast 46, the handlebar 48, cable and the deflector 76.

When the crankshaft of the engine 32 drives the impeller shaft thereby causing the impeller 72 to rotate, water is drawn from the surrounding body of water through the inlet port 68. The pressure generated in the housing 70 by the impeller 72 produces a jet of water that is discharged through the discharge nozzle 74 and the deflector 76. The water jet produces thrust to propel the watercraft 30. Maneuvering of the deflector 76 changes the direction of the water jet. Thus, the rider can turn the watercraft 30 in either the right or the left direction by operating the steering mechanism 80.

The illustrated engine 32 operates on a two cycle combustion principle. The engine 32 has a cylinder block (not shown) that defines at least one cylinder bore (not shown). A corresponding number of pistons (not shown) are slidably supported in the cylinder bores for reciprocal movement.

The illustrated cylinder block defines one cylinder bank with three cylinder bores. As such, the illustrated engine 12 is an in-line 3-cylinder engine. However, it should be appreciated that the features and advantages of the present inventions can be achieved utilizing an engine with different cylinder configurations (e.g., V, W, or opposed), a different number of cylinders (e.g., one, two, four) and/or a different principle of operation (e.g., four-cycle, rotary, or diesel principles).

A cylinder head assembly (not shown) affixed to one end of the cylinder block so as to close the cylinder bores. The cylinder head assembly, the cylinder bores, and the pistons form the combustion chambers (not shown) of the engine 32. The other end of the cylinder block is closed with a crankcase member, which defines a crankcase chamber (not shown).

A crankshaft (not shown) rotates in the crankcase chamber. The crankshaft is connected to the pistons by connecting rods (not shown) and rotates with the reciprocal movement of the pistons. As is typical with two cycle crankcase compression engines, the portions of the crankcase chamber associated with each of the cylinder bores are sealed from each other. The crankshaft is also coupled to a driveshaft (not shown) that drive the impeller 72 of the jet pump 64.

An air induction system, which is indicated generally by the reference numeral 49, is configured to supply an air charge to the crankcase chamber. The induction system 49 includes an air inlet device 28 that can be configured to smooth and quiet the air flowing into the induction system 49.

The indication system 49 also includes an intake passage 53 having an inlet end and an outlet end. The inlet end of the intake passage 53 opens into the intake device 51. The outlet end of the intake passage 53 opens toward an intake port in the crankcase of the engine 32. The engine 32 can have only one intake passage 53 feeding one or more cylinder bores, one intake passage 53 for each cylinder bore, or plural intake passages 53 feeding a larger number of cylinder bores.

A throttle valve 54 is disposed in each of the intake passages 53. The throttle valve 54 is configured to control or meter an air amount flowing through the intake passage 53. In the illustrated embodiment, the throttle valve 54 is a butterfly-type valve mounted on a throttle valve shaft 55 which is rotatably mounted relative to the intake passage 53. The throttle valve 54 thus can be rotated to open and close the intake passage 53, and thus affect the power output of the engine 32.

A reed-type check valve (not shown) is provided between the outlet end of the intake passage 53 and the intake port in the crankcase. The reed-type check valves 36 is configured to permit an air charge to be drawn into the crankcase chamber when the respective piston is moving upwardly in its cylinder bore. As the piston moves downwardly, the charge in the crankcase chamber will be compressed and the respective reed type check valve 36 closes to preclude reverse flow.

As is well known in the art of two-cycle engines, each cylinder bore is provided with a scavenging system such as a Schnurl type scavenging system. Accordingly, the cylinder bore preferably includes a pair of side, main scavenge ports and a center, auxiliary scavenge port. Scavenge passages connect the crankcase chamber with each of the scavenge ports. As is well known in two cycle practice, the scavenge ports are opened and closed by the reciprocation of the pistons in the cylinder bores.

Preferably, the main scavenge ports are disposed on opposite sides of an exhaust port (not shown) which is diametrically opposite the center auxiliary scavenge port.

The exhaust ports communicate with exhaust manifolds (not shown) that are formed integrally within the engine block.

The exhaust manifolds terminate in exhaust pipes (not shown) that depend into an expansion chamber (not shown) formed in the driveshaft housing and lower unit. The expansion chamber communicates with an exhaust gas discharge. The exhaust gas discharge preferably is disposed below a waterline of the hull 36 when the watercraft 30 is floating at rest on a body of water. The exhaust system employed forms no part of the present invention and therefore can be considered conventional.

Figure 4:
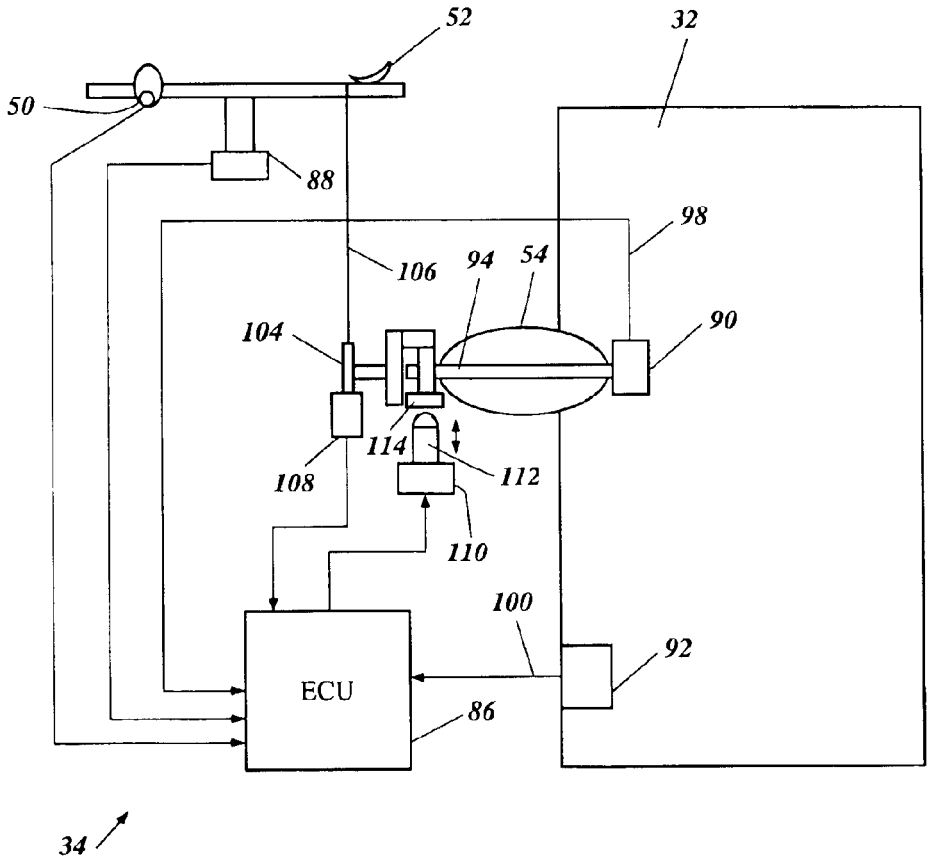
FIG. 4 is a schematic view of an engine output control system of the watercraft shown in FIG. 1.
Figure 5A:
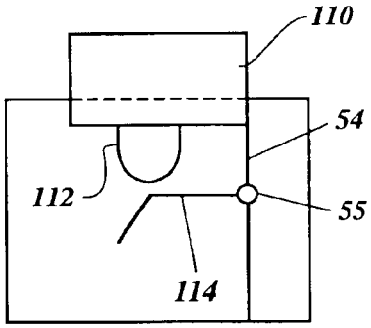
FIG. 5 includes schematic views of the control system operation, showing the action of a stepper motor and a throttle valve, in which (a) shows a state in which the push pin is in a retracted position, (b) shows a state in which the push pin is extended, (c) shows a state in which a lever portion of the throttle valve abuts against the extended push pin, and (d) shows a state in which the lever portion abuts against the push pin as the push pin is retracted.
Figure 5C:
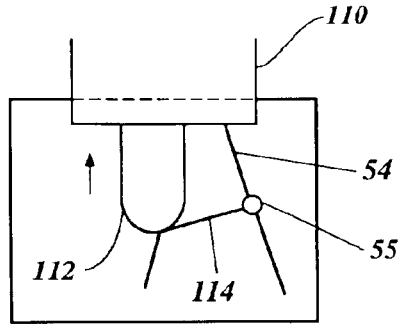
Figure 5B:
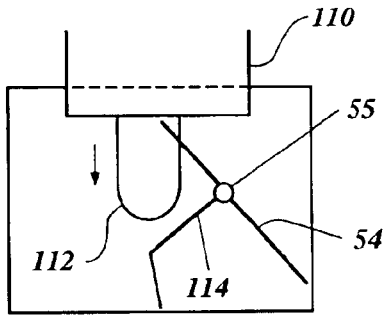
Figure 5D:
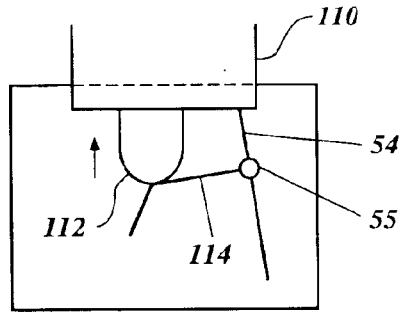

As schematically shown in FIGS. 1 and 4, the engine control system 34 preferably includes an Electronic Control Unit (ECU) 86 configured to control at least one operation of the engine 32. In the illustrated embodiment, the ECU 86 is connected to a steering position sensor 88, a throttle position sensor 90 and an engine speed sensor 92. The ECU 86 is preferably mounted on the engine 32 or disposed in the proximity to the engine 32. Alternatively, the ECU 86 can be disposed remotely from the engine 32.

The steering position sensor 88 is preferably positioned adjacent to the steering mast 46 so as to sense an angle of the steering mast 46 when the rider turns it. Other types of sensors or sensing mechanisms also can be used to sense the state of the steering mechanism 80.

The throttle position sensor 90 is preferably affixed at one end of the throttle valve shaft 55 and is configured to sense the position of the throttle valves 54. Additionally, the sensor 90 is configured to emit a signal indicative of the position of the throttle valves 54.

The engine speed sensor 92 is preferably placed in the proximity of the engine 32 so as detect the speed of the engine 32. For example, the sensor 92 can be disposed adjacent a flywheel (not shown) of the engine 32. In this embodiment, the sensor 92 can be configured to detect the movement of teeth of the flywheel, and to generate a signal indicative of the movement of such teeth. Such a signal can be processed by the ECU 86 so as to calculate a speed of the engine 32. Of course, other types of engine speed sensors can be used.

The respective sensors 88, 90, and 92 are connected to the ECU 86 through signal lines 98, 96, and 100. Of course, the signals can be sent through other means such as radio waves, detector pins, infrared radiation, and the like.

Other sensors can also be provided. For example, but without limitation, the engine 32 can also include a fuel pressure sensor (not shown) for detecting a fuel pressure, an intake air temperature sensor (not shown) for detecting a temperature of the intake air, an oxygen ($O_2$) sensor (not shown) for detecting a residual amount of oxygen, a water temperature sensor (not shown) for detecting a temperature of the cooling water, a water amount sensor (not shown) for detecting an amount of water removed by a fuel filter, an exhaust pressure sensor (not shown) for detecting an exhaust pressure in the exhaust system, a lubricant level sensor (not shown) for detecting an amount of lubricant in a lubricant tank, a knock sensor (not shown) for detecting a knocking in the engine, and an engine temperature sensor (not shown) for detecting a temperature of the engine 32.

Figure 2:
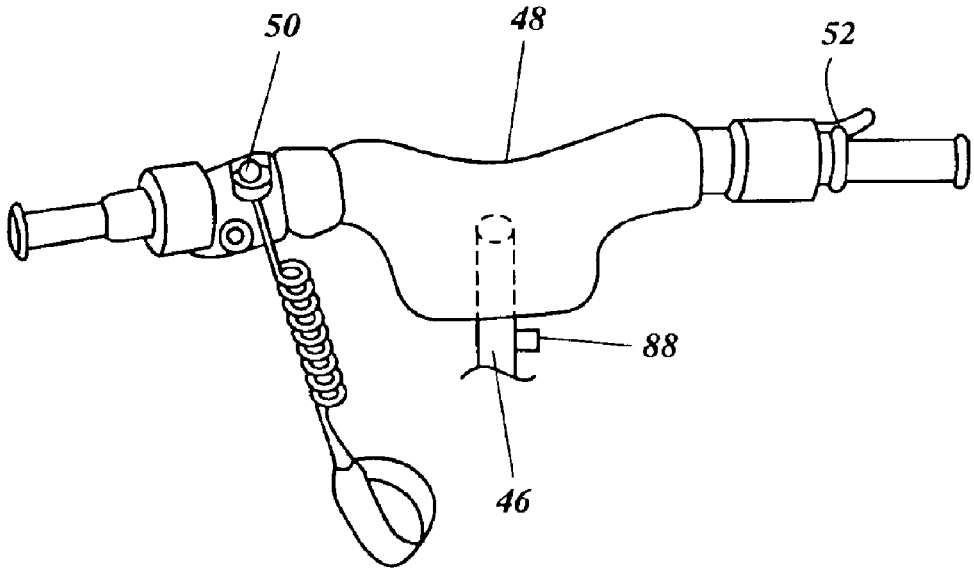
FIG. 2 is a perspective view of the handlebar illustrated in FIG. 1.

The aforementioned throttle valve 54 is actuated by operating a throttle lever 52 of the steering handle 48 shown in FIG. 2. By adjusting the opening of the throttle valve 54 of the engine 32 shown in FIG. 3, the engine output is adjusted and the velocity of the boat can be changed.

The throttle position sensor 90 is provided at one end of the throttle shaft 94. A pulley 104 is provided on the other end of the throttle shaft 94 as shown in FIG. 4. The pulley 104 and the throttle lever 52 are connected by a throttle cable 106, so that the throttle opening can be changed by operating the throttle lever 52.

A closed state detection sensor 108 is disposed adjacent to the throttle valve pulley 104. The closed state detection sensor 108 is configured to detect the closed state of the throttle valve 54. The closed state detection sensor 108 communicates to the ECU 86, that the throttle valve is closed when the operator has completely released the throttle lever 52.

When the throttle lever 52 is depressed, the throttle valve 54 is opened against a biasing force of a spring (not shown) via the throttle cable 106. When the throttle lever 52 is released from the gripped state, the throttle valve 54 is rotated toward the closed position at a high speed due to the force of the spring. This state is referred to herein as the uncontrolled return speed of throttle valve 54, and the speed of engine speed reduction in this case is referred to herein as the uncontrolled reduction speed.

As shown in FIG. 4, a stepper motor 110 is disposed in the vicinity of the pulley 104. A push pin 112 is connected to the stepper motor 110. The stepper motor 110 is configured to move the push pin 112 toward and away from the stepper motor 110.

A lever 114 includes a first end connected to the throttle valve shaft 55 and a second free end extending away from the shaft 54. The lever is positioned such that when the throttle shaft 55 is rotated so as to open the throttle valve(s) 54, the second free end of the lever 114 moves away from the pin 112. For certain operations, the stepper motor 110 is configured to move the pin 112 forward and backward at a predetermined time and speed, for controlling the speed of closing the throttle valve 54.

As shown in FIG. 4, the stepper motor 110, the throttle opening detection sensor 90, the steering sensor 88, the engine speed detection sensor 92, and the closed state detection sensor 108 are connected to the ECU 86.

As noted above, during operation of a watercraft such as the watercraft 30, and most significantly during maximum acceleration of the engine speed, the actual speed of the engine 32 can increase more quickly than the speed of the watercraft 30. Thus, during acceleration of the engine speed, there is a disparity in the proportion of an increase in engine speed to an increase in watercraft speed.

One aspect of at least one of the inventions disclosed herein includes the realization that a filtered engine speed value can be more in proportion to the watercraft speed than actual engine speed, and thus provide a more accurate proportional indicator of watercraft speed, under at least some circumstances. Thus, the engine speed itself can be used as a basis for estimating watercraft speed for engine control operations, thereby avoiding the use of a sensor that directly detects watercraft speed. In the illustrated embodiment, a filtered engine speed Ne1 is determined and used as an indication of the speed of the watercraft 30 for engine control purposes.

The filtered engine speed Ne1 is a value based on the actual speed of the engine 32. For example, the filtered engine speed Ne1 can be a value based on the output from the engine speed sensor 92, or the value calculated by the ECU 86 based on the output of the engine speed sensor 92. Preferably, the method for determining the filtered engine speed Ne1 provides a value that changes approximately proportionally to the watercraft speed, at least some of the time during operation of the watercraft 30.

In the illustrated embodiments, the filtered engine speed introduces a lag. In other words, changes in the filtered engine speed Ne1 lag behind changes in the actual engine speed. The lag can compensate for the inertial effect of the mass of the watercraft 30, the friction between the watercraft 30 and the water, and/or other mechanisms which prevent the watercraft 30 from accelerating more quickly. By introducing a such a lag, actual watercraft speed can be more accurately estimated without using a sensor that directly detects the speed of the watercraft 30.

Figure 6:
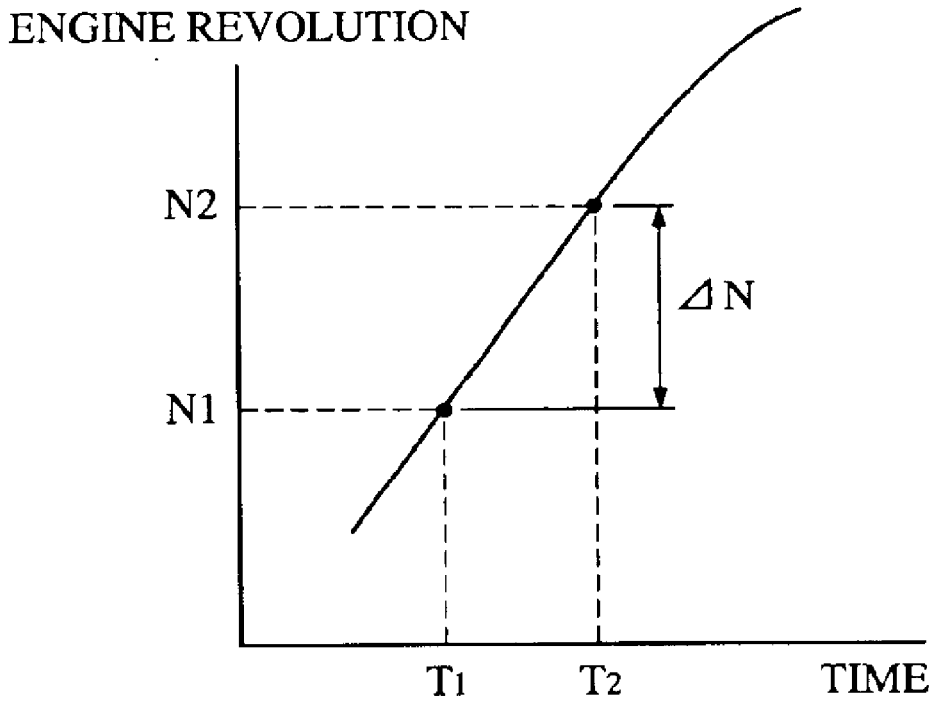
FIG. 6 is a graph showing a relation between the time and actual engine speed.

With reference to FIG. 6, the filtered engine speed Ne1 can be based on a change in the actual engine speed. For example, as shown in FIG. 6, a change in actual engine speed ΔN is based on the difference between an engine speed N1 at time T1 and an engine speed N2 at time T2.

In one embodiment, the filtered engine speed Ne is a simple moving average of the actual engine speed of the engine 32. For example, with reference to FIG. 7, the filtered engine speed Ne5 can be calculated by the following equation:

$$Ne5=(N1+N2+N3+N4)/4$$

Ne5=filtered engine speed at time T5

Nn=actual engine speed at time Tn n=integer values

In this embodiment, the recently recorded engine speed values are summed, and divided the number of sampled engine speeds used in the calculation, to determine the filtered engine speed. Thus subsequent filtered engine speeds can be determined as follows:

$$Ne6=(N2+N3+N4+N5)/4$$

$$Ne7=(N3+N4+N5+N6)/4$$

In another embodiment, the filtered engine speed Ne can be calculated in accordance with a "weighted moving average" principle, wherein weight is given to each sampled engine speed, relative to the order of sampling, by the following equation:

$$Ne5=(N1k1+N2k2+N3k3+N4k4)/(k1+k2+k3+k4)$$

Ne5=filtered engine speed at time T5

Nn=actual engine speed at time Tn kn=weighting coefficient for the engine speed Nn at time Tn, wherein k(n)>k(n−1)>k(n−2)

n=integer values

This embodiment emphasizes the most recently sampled engine speed. The most recent engine speed sample (N4) is more greatly weighted than the most time-distant engine speed sample (N1). For example, in determining the filtered engine speed Ne5 at time T5, the engine speed sampled in the prior sampling cycle, i.e., engine speed N4 at time T4, is multiplied by the highest coefficient k4 , thereby attributing the greatest weight to the most recently sampled engine speed N4. The remaining engine speeds, N3, N2, N1 are respectively multiplied by smaller coefficients, k3, k2, k1, thereby attributing less weight to more time-distant engine speeds.

In another embodiment, the filtered engine speed Ne can be calculated in accordance with an exponential moving average principle, for example, by the following equation:

$$Ne_n=Ne_{(n-1)}+(N_n-Ne_{(n-1)})K$$

$$Ne_0=N_0$$

$N_n$=actual engine speed at time $T_n$ $Ne_n$=filtered engine speed at time $T_n$ T=time K=coefficient In this embodiment, the filtered engine speed $Ne_n$ is found by subtracting a previously calculated filtered engine speed $Ne_{(n-1)}$ from the actual engine speed at the desired time $N_n$; multiplying that value by the coefficient K; then adding the filtered engine speed from the immediately previous time step $Ne_{(n-1)}$).

Figure 7:
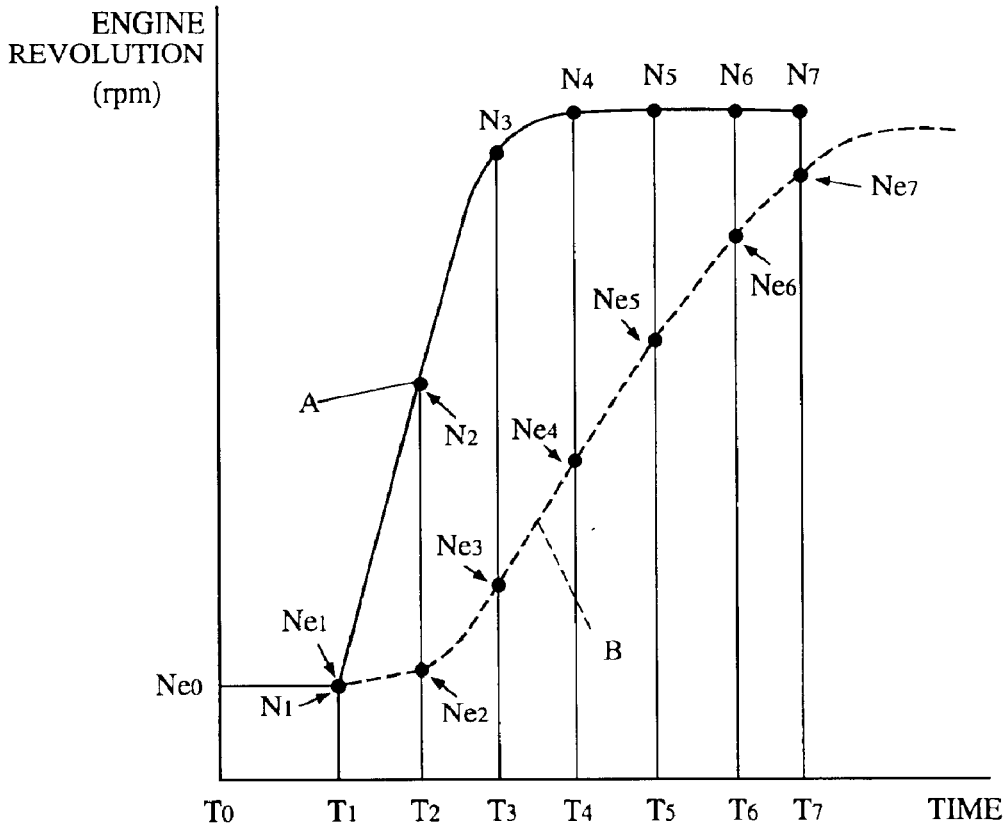
FIG. 7 is a graph showing a first curve illustrating a relationship between time and actual engine speed and a second curve illustrating a relationship between time and filtered engine speed.

The dashed curve of FIG. 7 schematically illustrates the resulting filtered engine speeds resulting from the above alternatives for determining the filtered engine speed. The effect provided by the filtered engine speed calculation is apparent when comparing curve B to the curve produced by the unfiltered engine speed labeled A over the same period. The apparent lag between the two curves is similar to the lag between the actual engine speed and a speed of the watercraft. The, the filtered engine speed calculation aids in compensating for the effects caused by the mass of the watercraft, and the friction between the hull 36 and the water on the speed of the watercraft 30.

With such a filtering process, the characteristic curve B approximates the actual speed of the watercraft 30. Therefore, an apparatus for directly measuring the watercraft speed can be avoided. Instead, a value that is approximately proportional to the actual watercraft speed can be determined with reference to the data provided by the engine speed sensor 92.

The filtering process can make use of any device or method that would produce a lag. For example, a slip clutch mechanism may be used to mechanically introduce a lag. In another embodiment, an integrator circuit can be hardwired into the system to electrically introduce a lag. Where the above mathematical methods are used, various parameters can be tuned to provide the desired lag, or proportionality to the watercraft speed. For example, the coefficients identified as "k" or "K" can be changed to provide a corresponding change in the resulting modified engine speed value. Additionally, the period between the times T1, T2, T3, T4, etc, can also be adjusted to change the lag at which the modified engine speed, e.g., the filtered engine speed Ne, value follows the actual engine speed N.

The above exemplary embodiments for introducing lag are not meant to limit the scope of the invention, and should not be read to exclude embodiments made of various off the shelf components, but are examples of how a lag can be introduced in to a system.

With reference to FIGS. 5(*a*)–(*d*) and the flow charts of FIGS. 8 and 9, an engine speed control routine 115 is described below. FIG. 5(*a*) illustrates a state in which the throttle valve 54 is closed and the push pin 112 of the stepper motor 110 is set to the retracted position by the ECU 86, which corresponds to when the engine is stopped as well as other states of operation.

Figure 8:
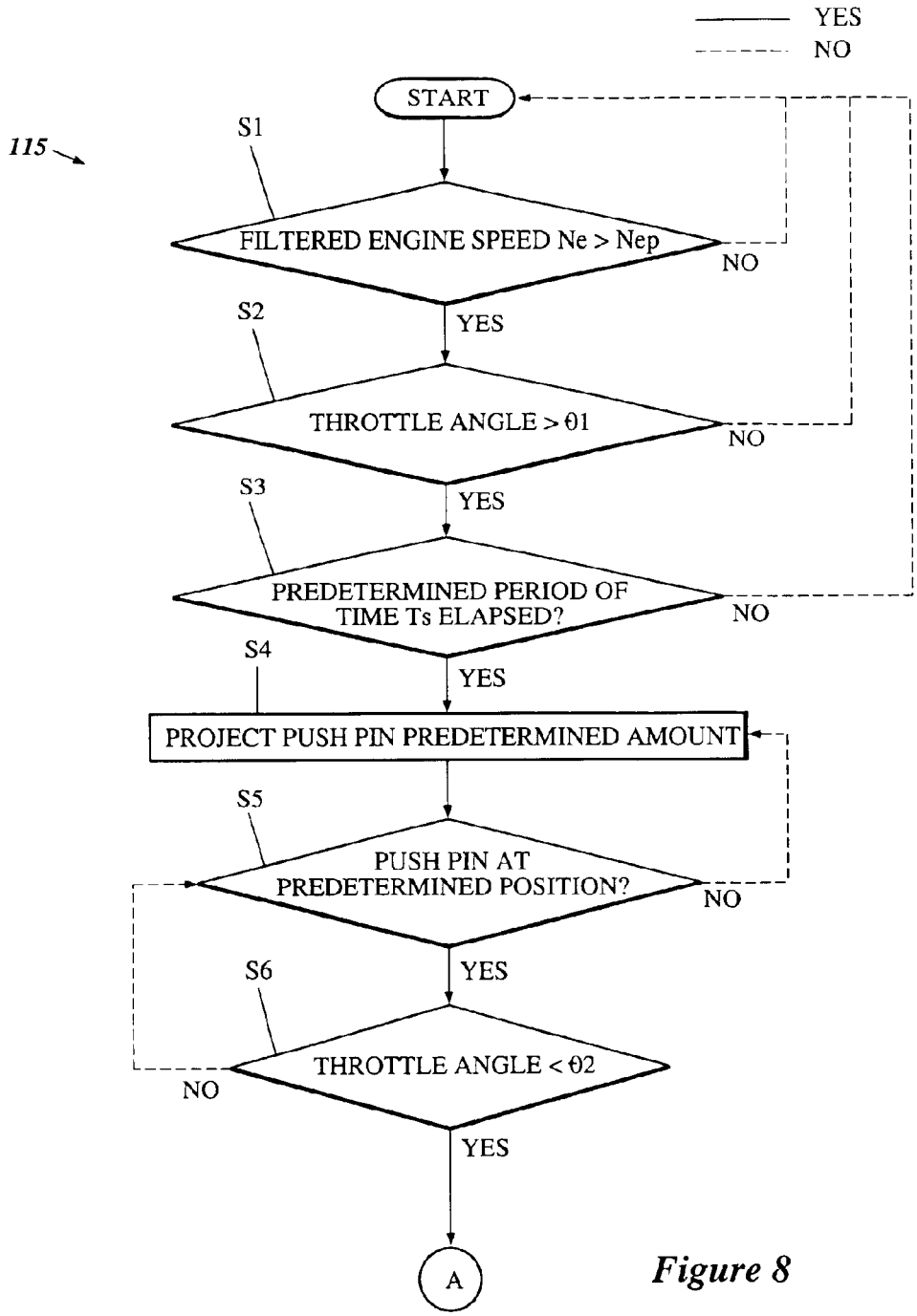
FIG. 8 is a first portion of a flow chart illustrating a control routine which can be used to control the output control system of FIG. 4.

With reference to FIG. 8, the control routine 115 can begin when the engine 32 is started, and moves to a decision block S1 in which it is determined if a filtered engine speed Ne1 is larger than the predetermined value Nep. The filtered engine speed Ne1 can be determined in accordance with any of the above-described embodiments. The predetermined value Nep is a predetermined value that defines minimum filtered engine speed that is exceeded before the control routine 115 affects engine output. For example, the predetermined value Nep can correspond to a minimum watercraft speed, below which additional thrust or steering force is not desired. For example, the predetermined value Nep can correspond to the minimum speed at which the watercraft 30 can enter a planing mode of operation. Alternatively, the predetermined value Nep can be greater or less than this minimum value. In another alternative, the predetermined value Nep can be a value corresponding to a minimum thrust required for changing the direction of travel of the watercraft 30. Routine experimentation can be used to determine a desired predetermined value Nep.

If the filtered engine speed Ne1 is smaller than the predetermined engine speed value Nep, the routine 115 returns to the start of the routine 115. If it is determined that the filtered engine speed N1 is larger than Ne1, the routine 115 moves to a decision block S2.

At the decision block S2, it is determined whether or not an opening amount of the throttle valve is greater than a predetermined opening amount. For example, the ECU 86 can sample the output of the throttle position sensor 90, determine an opening angle of the throttle valve 54 based on the output of the sensor 90, and compare the opening angle to the predetermined angle 1.

In an exemplary but non-limiting example, the predetermined angle can be a throttle valve 54 opening amount that produces enough propulsion force for sustained acceleration of the watercraft 30. In other words, the determination of decision block S3 is intended to determine weather the operator has applied throttle with intention to accelerate. If the throttle valve is not opened beyond the predetermined value 1 engine reduction control is not desired.

Thus, at the decision block S3, if the actual opening angle is not greater than the predetermined angle 1, the routine 115 returns to Start. If the actual opening angle is greater than the predetermined angle 1, the routine 115 moves to a decision block S3.

At the decision block S3, it is determined whether or not the predetermined period of time $T_s$ has elapsed. The predetermined amount of time $T_s$ can be the time required for the watercraft 30 to be brought to a speed at which elevated engine speed or above-idle thrust is desired for effective steering. If this period of time Ts has not elapsed, the watercraft 30 is not yet at a watercraft speed at which elevated engine speed or above-idle thrust is desired for effective steering.

Thus, If the predetermined time $T_s$ has not elapsed, the routine 115 returns to start. If the predetermined time has elapsed, then the routine 115 proceeds to a operation block S4.

At the operation block S4, the stepper motor 110 is actuated and the push pin 112 is projected out to a predetermined position STP1. For example, the push pin 112 can be extended to the position illustrated in FIG. 5(*b*). The predetermined position STP1 can correspond to a position at which the throttle valve 54 would be held open at an opening amount sufficient to change a direction of travel of the watercraft 30 operating at an elevated speed, if the throttle lever 52 were released and the lever 114 rotated into contact with the pin 112. Preferably, the predetermined position STP1 corresponds to a position such that the push pin 112 does not contact the lever 114 when the push pin 112 is extended to the predetermined position STP1. The routine 115 then advances to a decision block S5.

At the decision block S5, it is determined whether or not the push pin 112 is extended to the predetermined position STP1. If the push pin is not extended to the predetermined position STP1, the routine returns to the operation block S4. If the push pin is extended to the predetermined position STP1, the routine then proceeds to a decision block S6.

At the decision block S6, it is determined whether or not the throttle valve 54 opening amount is smaller than a predetermined opening amount. For example, the ECU 86 can compare an actual throttle opening angle to a predetermined throttle opening angle 2.

When the opening amount is less than the predetermined opening amount 2, it is recognized that the throttle lever 52 has been released sufficiently to allow the throttle valve 54 to rotate sufficiently toward a closed position so as to prevent the engine 32 from producing sufficient thrust to turn the watercraft 30. For example, the operator might have completely released the throttle lever 52, or may have released the throttle lever 52 only partially. If it is determined that the throttle opening amount is not less than the predetermined amount 2, the routine 115 returns to the decision block S5. If it is determined that the throttle opening amount is less than the predetermined amount 2, the routine 115 proceeds to an operation clock S7.

Figure 9:
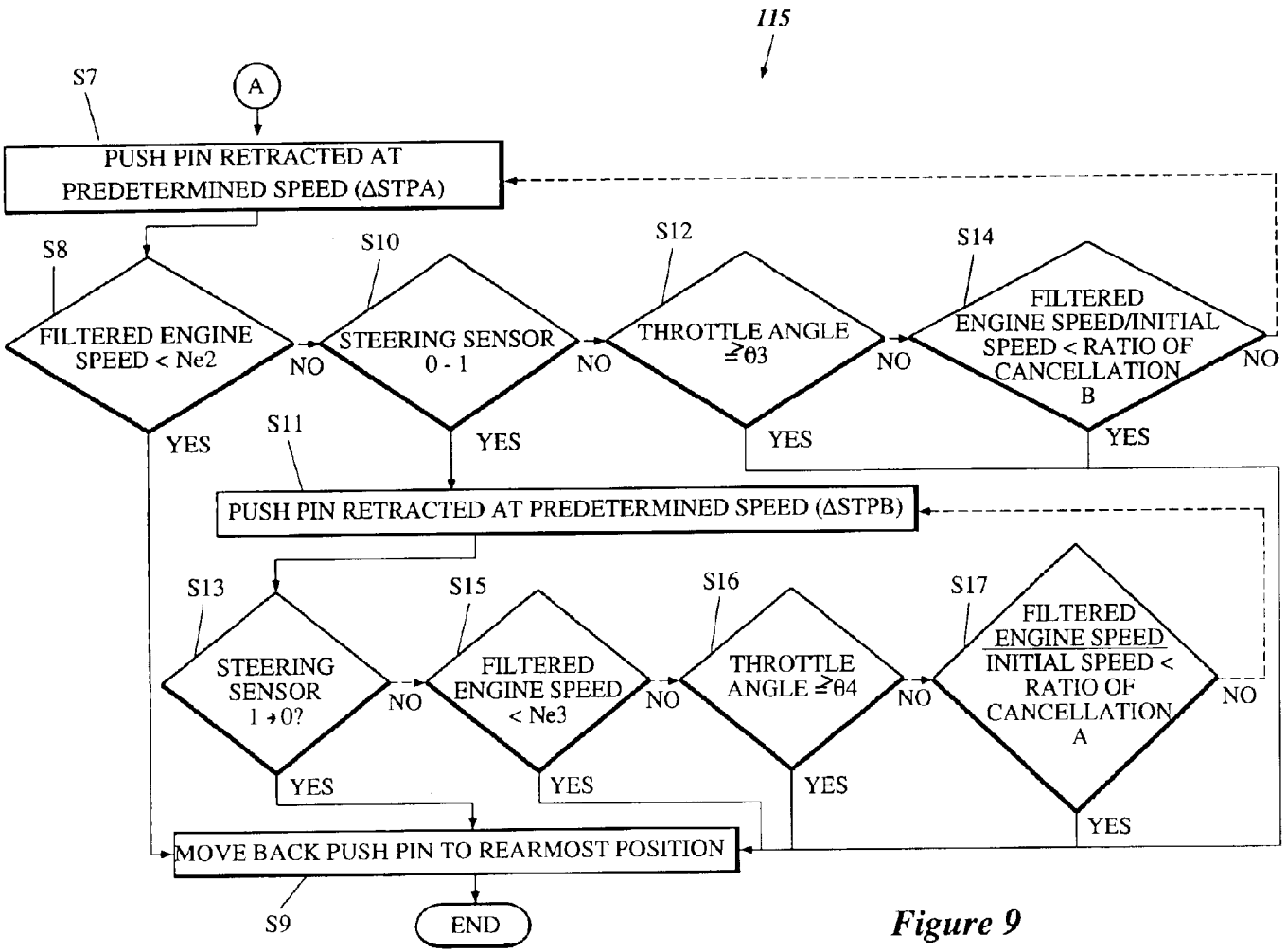
FIG. 9 is a second portion of the flow chart of FIG. 8.

As shown in FIG. 9, at the operation block S7, the stepper motor 110 is actuated so as to retract the push pin 112 at a predetermined speed STPA. The predetermined speed STPA is slower then the uncontrolled closing speed of the throttle valve 54.

When an operator releases the throttle lever 52, the throttle valve 54 closes at a uncontrolled speed due to the biasing force of the return spring. However, with the push pin 112 extended, the lever 114 contacts the push pin 112 as it rotates toward a closed position, thereby preventing the throttle valve 54 from closing further, as illustrated in FIG. 5(*c*). With the lever 114 being pressed against the push pin 112, the throttle valve 54 closes at the predetermined speed STPA, as illustrated in FIG. 5(*c*). Thus, the engine speed is reduced at a slower rate than the aforementioned uncontrolled reduction speed.

The predetermined speed STPA can be a fixed speed. Preferably the predetermined speed STPA is preferably determined based on the filtered engine speed Ne, calculated over a predetermined period of time immediately before the routine 115 reaches the operation block S7, and is stored in the memory of the ECU 86. The predetermined speed STPA is preferably determined from a three-dimensional correlation table including the speed N of the engine 32, the returning angular speed of the throttle valve 54, and the returning speed of the push pin 112.

Since the steering force required to change the direction of the watercraft 30 varies with the watercraft speed, a returning speed which generates enough steering force for comfortable and effective steering may be obtained from the correlation table by; first accessing the engine's average speed immediately before the operation block S7, determining the returning angular speed of throttle valve 54, and thirdly, from these to values, determining the desired returning speed of the push pin 112 from the correlation table.

After the operation block S7, the routine 115 proceeds to the decision block S8.

In the decision block S8, it is determined whether or not the second predetermined filtered engine speed Ne is smaller than the second predetermined value Ne2. The second predetermined value Ne2 is a filtered engine speed, below which an additional propulsive force is not desired. This is the case when the watercraft 30 has slowed below a predetermined speed, approximated by the predetermined filtered engine speed Ne2. If the filtered engine speed Ne is smaller than second predetermined filtered engine speed Ne2, then the throttle lever 52, or the propulsion request device, has not been released sufficiently abruptly that additional power output from the engine 32 is desirable. The routine then proceeds to a step S9.

In step S9, the push pin 112 of the stepper motor 110 moves to the retracted position as shown in FIG. 5(*a*), and the ECU 86 terminates the engine speed control.

At the decision block S8, if it is determined that the filtered engine speed Ne is greater than the second predetermined filtered engine speed Ne2, then the throttle lever 52, or the "propulsion request device" has been released sufficiently abruptly that it is desirable that the additional power output be continued. The routine 115 thus proceeds to a decision block S10.

At the decision block S10, it is determined whether or not the handlebar is turned beyond a predetermined angle. For example, the ECU 86 can determine if the steering sensor 88 detects that the handlebar 48 has been turned beyond a predetermined angle. The ECU 86 can be configured to set a steering flag to "1" if the steering sensor indicates that handle bar has been turned beyond the predetermined angle, and to set the flag to "0" is the handlebar has not been turned beyond the predetermined angle.

Alternatively, the steering sensor 88 can be configured to emit two signals, one signal indicating that the handlebar has not been turned beyond a predetermined degree, and a second signal indicating that the handlebar 48 has been turned beyond the predetermined angle. For example, the steering sensor 88 can be in the form of a proximity sensor which is positioned and configured to emit a "0" volt signal when the handlebar 48 has not been turned beyond a predetermined degree and to emit a "1" volt signal if the handlebar 48 has been turned beyond a predetermined degree. The predetermined angle can be any angle which would indicate that the operator of the watercraft 30 intends to change the direction of travel of the watercraft 30. If, in the decision block S10, it is determined that the handlebar 48 has been turned beyond the predetermined angle, the routine 115 proceeds to an operation block S11.

At the operation block S11, the push pin 112 is retracted at the second predetermined speed ΔSTPB which is a slower rate than the above-noted speed first predetermined speed ΔSTPA.

The second predetermined speed ΔSTPB can be stored in a two- or more dimensional correlation table (not shown) which correlates engine speed and the second predetermined speed ΔSTPB rate. Such a correlation table can be stored in the memory of the ECU 86. Thus, the correlation tables for the first predetermined speed ΔSTPA is different from the correlation table for the second predetermined speed ΔSTPB.

The first and second predetermined rates ΔSTPA, ΔSTPB allow the throttle valve 54 to close at different rates so as to enhance the comfort of a user of the watercraft 30 during operation. For example, when the handlebar 48 is not turned and thus additional thrust for steering purposes is not desired, the push pin 112 is retracted at the faster of the rates, i.e., the first predetermined speed ΔSTPA, so as to allow the engine speed to fall smoothly. This prevents abrupt changes of speed when the throttle lever 52 has been released so as to enhance the comfort of the operator.

When the handlebar 48 is turned beyond a predetermined angle, and additional steering thrust is desired, the throttle valve 54 is allowed to close at a slower rate ΔSTPB. Thus, when the additional steering thrust is provided, there is a less pronounced difference between when there is and when there is not additional steering thrust provided. In other words, there is a less perceptible difference between the feeling experienced by the operator when throttle valve 54 closes at the rate ΔSTPA and when the throttle valve 54 closes at the second predetermined speed ΔSTPB. Thus, the operator is provided with a more comfortable riding experience. After the operation block S11, the routine 115 proceeds to a decision block S13.

At the decision block S13, it is determined whether the handlebar 48 has been turned back toward a position that is less than a predetermined angle. The predetermined angle can be the same predetermined angle used in the decision block S10. Alternatively, a different predetermined angle can be used. If it is determined that the handlebar 48 has been returned to a position less than the predetermined angle, the routine 115 moves to the operation block S9, in which the push pin 112 is retracted, thereby allowing the throttle valve 54 to close completely, as noted above.

However, if at the decision block S13, it is determined that the handlebar 48 has not been returned to a position less than the predetermined angle, the routine 115 proceeds to a decision block S15.

In the operation block S15, it is determined if the filtered engine speed Ne is less than a third predetermined filtered engine speed Ne3. The third filtered engine speed Ne3 can be the same as the second filtered engine speed Ne2. However, more preferably, the third filtered engine speed Ne3 is a value less than the second predetermined filtered engine speed Ne2. More preferably, the third predetermined filtered engine speed Ne3 is a filtered engine speed, below which additional steering thrust is not desired. For example, the third predetermined filtered engine speed Ne3 can correspond to a watercraft speed below which additional steering thrust is not desired.

If, in the decision block S15, it is determined that the present filtered engine speed Ne is less than the third predetermined filtered engine speed Ne3 the routine 115 proceeds to the operation block S9, described above. However, if at the decision block S15, it is determined that the filtered engine speed Ne is not less than the third predetermined filtered engine speed Ne3, the routine proceeds to decision block S116.

At the operation block S16, it is determined whether the opening amount θ of the throttle valve 54 is greater than or equal to a fourth predetermined throttle angle θ4. The fourth predetermined throttle angle θ4 can be a throttle angle which indicates that the operator has operated the throttle lever 52 so as to move the lever 114 away from the push pin 112 (FIG. 4). As such, the operator has decided to open the throttle valve 54 further than the throttle opening amount provided by the routine 115. The fourth predetermined throttle angle θ4 can be determined by correlating the position of the push pin with a throttle angle. Thus, if the present throttle angle is larger than that which would be provided by the push pin 112 if the throttle lever 52 were completely released, then the throttle lever 52 is being operated to move the lever 114 away from the push pin 112. If it is determined that the present throttle angle θ is larger than the fourth predetermined throttle angle θ4, the routine 115 moves on to the operation block S9, and terminates the throttle control provided by the routine 115. However, if the current throttle angle θ is not greater than or equal to the fourth predetermined throttle angle θ4, the routine 115 moves on a decision block S17.

At the decision block S17, it is determined whether a ratio of the present filtered engine speed Ne to the initial engine speed when the speed control began. For example, the initial engine speed can be a filtered engine speed Nei when the operation block S7 is performed, i.e., when the pin 112 is first retracted at the first predetermined speed ΔSTPA. As the filtered engine speed drops, the ratio of the current filtered engine speed Ne to the initial filtered engine speed Nei also drops.

The predetermined ratio of cancellation A can be a ratio that would indicate that the engine speed has dropped sufficiently such that the engine 32 no longer provides a sufficient steering force for changing the direction of travel of the watercraft 30. Thus, if the ratio of the current filtered engine speed Ne to the initial filtered engine speed Nei is below the predetermined rate of cancellation A, the routine 115 moves to the operation block S9 and terminates engine speed control. However, if it is determined, in the decision block S17, that the ratio of the current filtered engine speed Ne to the initial filtered engine speed Nei is less than the predetermined cancellation ratio A, the routine 115 returns to the operation block S11 and repeats.

With reference again to the decision block S10, if it is determined that the handlebar 48 has not been turned beyond the predetermined angle, the routine 115 moves on to a decision block S12.

At the decision block S12, it is determined if the current throttle valve opening amount θ is greater than a third predetermined throttle opening θ3. The third predetermined throttle amount opening θ3 can be determined in the same manner as the manner described above with reference to the decision block S16 and the fourth throttle opening amount θ4. Thus, if the current throttle angle θ is greater than the third predetermined throttle opening amount θ3, the operator has operated the throttle lever 52 and thus moved the lever 114 away from the push pin 112 (FIG. 12) so as to provide additional thrust. Thus, at the decision block S12, if the current throttle angle θ is greater than the third predetermined throttle opening amount θ3, the routine 115 moves to the operation block S9 and terminates speed control. However, if, at the decision block S12, the throttle angle θ is not greater than or equal to the third predetermined throttle opening amount θ3, the routine 115 proceeds to a decision block S14.

At the decision block S14, it is determined whether the ratio of the current filtered engine speed Ne to the initial filtered engine speed Nei is less than a ratio of cancellation B. The ratio of cancellation B can be determined in a similar manner to the ratio of cancellation A described above with reference to the decision block S17. Additionally, the ratio of cancellation B is determined in light of that, at this point in the control routine 115, the throttle valve 54 has been closed at the first predetermined speed ΔSTPA. Additionally, the ratio of cancellation B is, as is the ratio of cancellation A, determined in light of the method for determining the filtered engine speed Ne.

If, at the decision block S14, it is determined that the ratio of the filtered engine speed Ne to the initial filtered engine speed Nei is less than the ratio of cancellation B, the routine 115 proceeds to the operation block S9 and terminates engine speed control. However, if the ratio of the current filtered engine speed Ne to the initial filtered engine speed Nei is not less than the ratio of cancellation B, the routine 115 returns to the operation block S7 and repeats.

Figure 10:
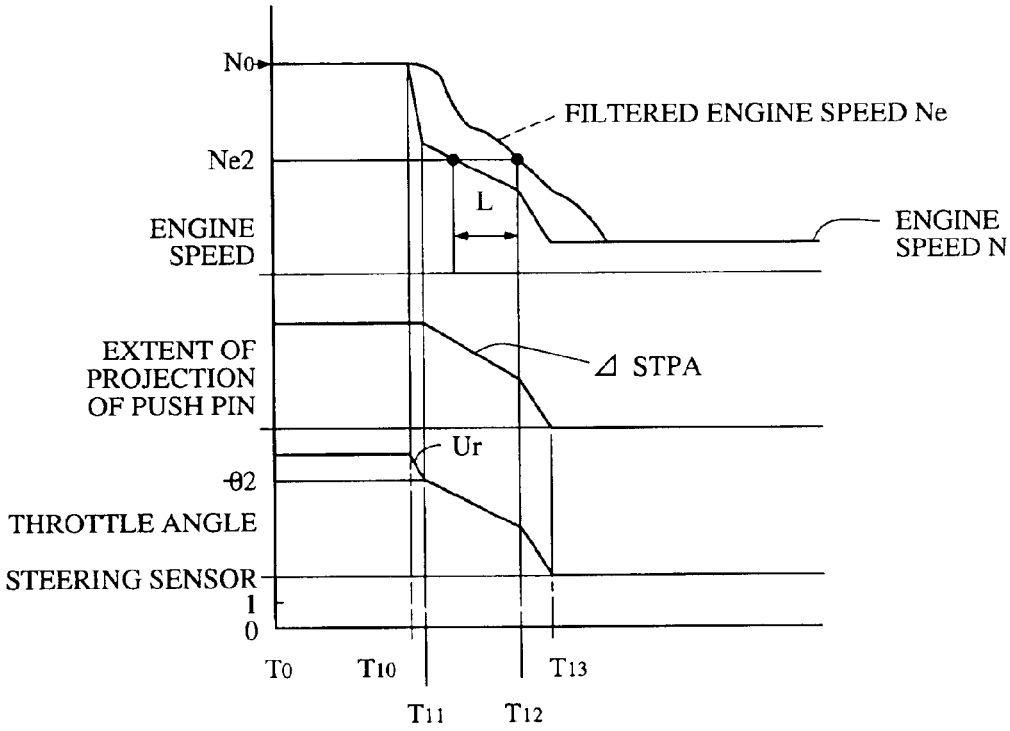
FIG. 10 is a graph schematically showing an exemplary operation of the control system in which the lateral axis represents the time, and vertical axis represents the filtered engine speed and the inputs and outputs of the control system.

With reference to FIG. 10, an exemplary operation of the control routine 115 is described below, with additional reference to the flowcharts of FIGS. 8 and 9. FIG. 10 schematically illustrates an exemplary operation of the engine 32 of the watercraft 30. A time T0 corresponds to a steady state operation of the engine 32 at an initial engine speed N0. The initial engine speed N0 is sufficiently high that the filtered engine speed Ne is greater than the initial predetermined filtered engine speed Nep (decision block S1), the throttle open amount θ is greater than the initial predetermined throttle opening amount θ1 (decision block S2), the predetermined period of time Ts has elapsed (decision block S3), and the push pin 112 has been extended (operation block S4 and decision block S5).

At the time T10, the operator has released the throttle lever 52 thereby allowing the throttle valve opening amount θ to close at an uncontrolled rate Ur. At time T11, the throttle opening amount θ has fallen below the second predetermined throttle opening amount θ2 (decision block S6). Thus, between the time points T11 and T12, the push pin 112 is retracted at the first predetermined speed ΔSTPA (operation block S7).

In the exemplary operation illustrated in FIG. 10, the handlebar 48 is not rotated beyond the predetermined angle. Additionally, the operator does not depress the throttle lever 52 between the time periods T11 and T12. Thus, the routine 115 repeats the decision blocks S8, S10, S12, S14, and the operation block S7, until an affirmative result is achieved in either decision blocks S8 or S14.

In the illustrated operation, the filtered engine speed Ne falls to the predetermined filtered engine speed Ne2 at the time T12. Thus, an affirmative result is achieved in the decision block S8. The routine 115 then, at the time T12, moves to the operation block S9 and terminates engine speed control, allowing the throttle valve 54 to close at the speed of retraction of the push pin 112, resulting in the closing of a throttle valve at the time T13.

As noted above, one advantage of using a modified engine speed for control purposes is that a modified engine speed value, such as for example, but without limitation, a filtered engine speed Ne, can be more in proportion to watercraft speed than the actual engine speed. For example, the speed of a watercraft engine can typically change speed abruptly. However, because the watercraft rides on a surface of water, the watercraft speed changes more slowly, due to the friction between the hull and the water, and due to the inertial effect of the mass of the watercraft. Thus, a modified engine speed value, that changes more slowly than the actual engine speed, can be more in proportion to the watercraft speed. As such, a modified engine speed value can be used as an indicator of he speed of the watercraft.

FIG. 10 schematically illustrates how the filtered engine speed Ne (dashed line) changes more slowly than the actual engine speed N (solid line). One example of this difference in the rate of change is identified with the letter "L". In particular, there is a delay or lag L between a time when the actual engine speed N falls to the value identified as the second predetermined filtered engine speed Ne2, and the time T12 at which the filtered engine speed Ne falls to the value Ne2.

In the illustrated embodiments, the lag L is not a fixed amount of time. Rather, the lag L is affected by numerous factors, for example but without limitation, the initial engine speed N0, the method used for calculating the modified engine speed value, which in turn can be determined based on the mass of the watercraft 30, an estimated friction coefficient between the water and the hull, etc., as well as the behavior of the actual engine speed N before and after the actual engine speed N falls to the second predetermined filtered engine speed Ne2, which in turn can be affected by operating conditions including the load on the engine.

Figure 11:
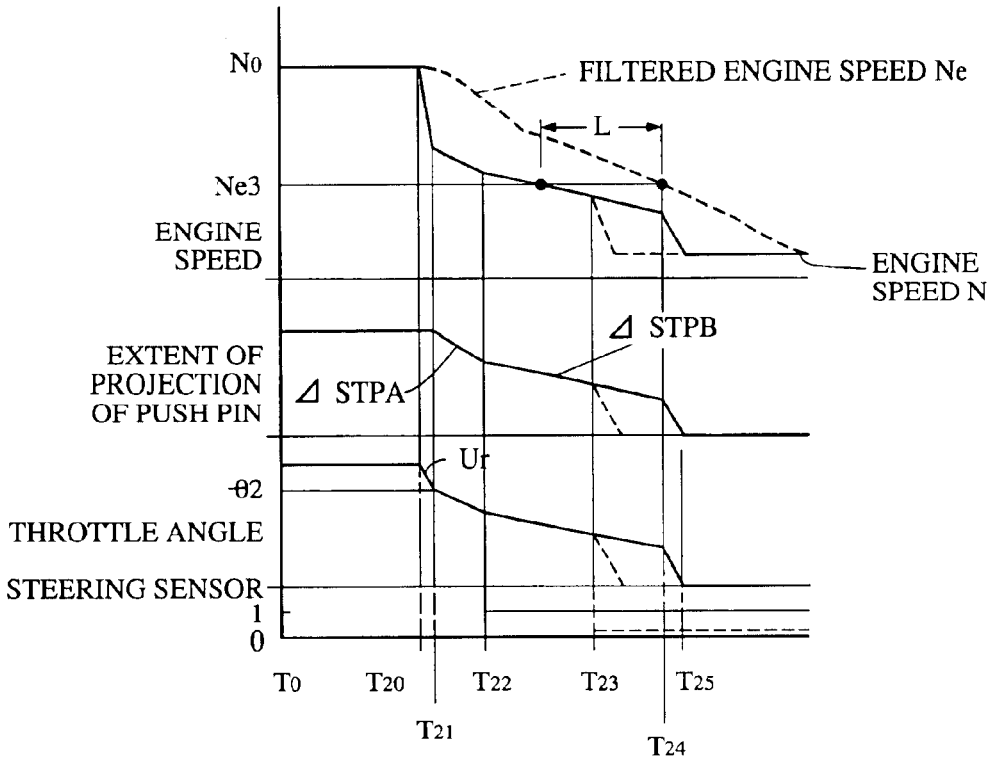
FIG. 11 is a graph schematically showing another exemplary operation of the control system in which the lateral axis represents the time, and the vertical axis represents the filtered engine speed and the inputs and outputs of the control system.

FIG. 11 illustrates another exemplary operation of the control routine 115. Similarly to the operation illustrated in FIG. 10, the exemplary operation of FIG. 11 begins at a Time T0 at which the initial engine speed N0, the filtered engine speed Ne, the throttle opening amount θ and a sufficient amount of time has elapsed such that the routine 115 reaches the decision block S6.

At the time T20, the operator releases the throttle lever 52, thereby allowing the throttle valve 54 to close at the uncontrolled rate Ur until the lever 114 contacts the push pin 112 (FIG. 5(*c*)) at the time T21. Thus, at the time T21, the control routine 115 reaches operation block S7, causing the push pin 112 to be retracted at the first predetermined speed ΔSTPA.

In the time between time periods T21 and T22, the handlebar 48 is not turned beyond the predetermined angle and the throttle lever 52 is not depressed so as to cause the throttle valve to move away from the push pin 112. Thus, between the time periods T21 and T22, the push pin 112 is retracted at the first speed ΔSTPA and the routine 115 repeats the decision block S8, S10, S12, S14, and the operation block S7.

At the time T22, the handlebar 48 is turned beyond the predetermined angle indicating that the operator desires to change a direction of travel of the watercraft. Thus, an affirmative result is reached at the decision block S10 of the routine 115 (FIG. 9). The routine 115 then reaches the operation block S11 and thus the push pin 112 is retracted at the second, lower, predetermined speed ΔSTPB.

Between the time periods T22 and T23, the handlebar 48 is maintained at a position beyond the predetermined angle and the throttle lever 52 is not depressed sufficiently to cause the lever 114 to move away from the push pin 112. Thus, between the time periods T22 and T23, the push pin is retracted at the second predetermined speed ΔSTPB.

The solid line representation of the output of the steering sensor 88 illustrated in FIG. 11 shows that the handlebar 48 is also maintained in the position beyond the predetermined angle between the time period T23 and T24. Thus, in this exemplary operation, the push pin 112 continues to be retracted at the second speed ΔSTPB until the time T24. Thus, the control routine 115 repeats decision blocks S13, S15, S16, S17, and the operation block S11 between the time periods T22 and T24.

At the time T24, the filtered engine speed Ne falls below the predetermined filtered engine speed Ne3. Thus, an affirmative result is achieved at the decision block S15, causing the control routine 115 to proceed to the operation block S9 to terminate engine speed control. Thus, between the time periods T24 and T25, the push pin 112 is retracted, allowing the throttle valve 54 to close at the time T25.

FIG. 11 also illustrates another exemplary operation, in which the handlebar 48 is returned to a position less than the predetermined angle, as illustrated in dashed line beginning at time T23. Thus, at the time T23, the control routine 115 achieves an affirmative result in the decision block S13. Thus, the routine 115 proceeds to the operation block S9, thereby retracting the push pin 112 and allowing the throttle valve 54 to close thereafter. Following the operation block S9, the routine 115 can end, or can return to the start illustrated in FIG. 8.

Figure 12:
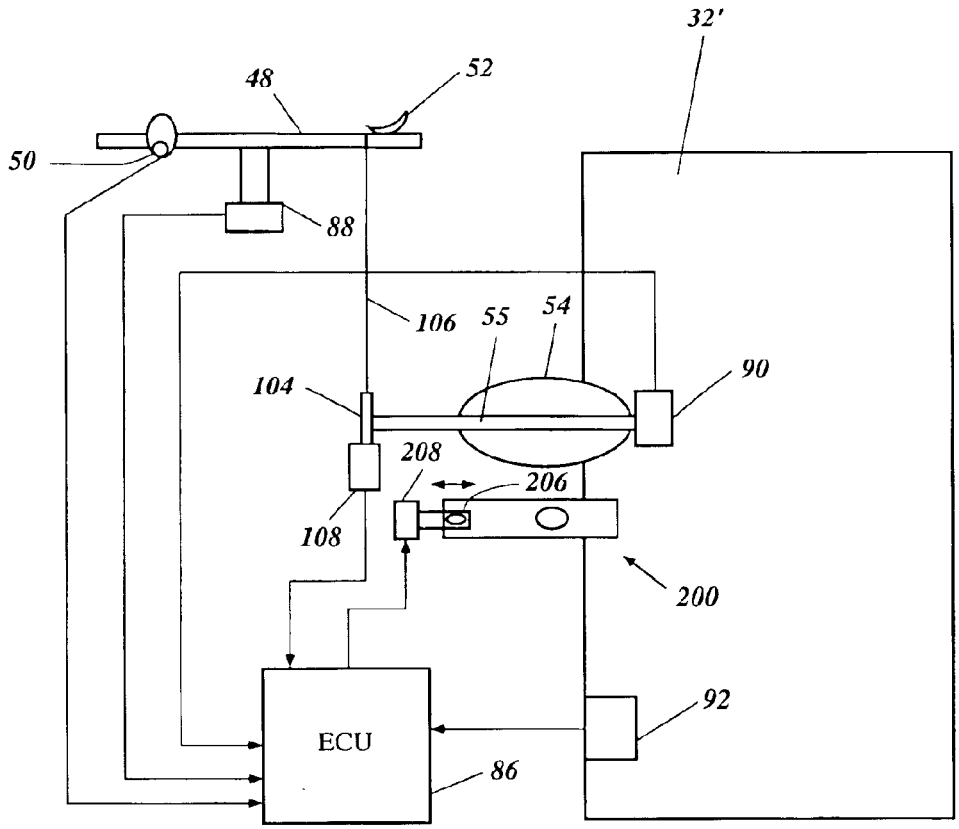
FIG. 12 is a schematic view of a modification of the engine output control system illustrated in FIG. 4.
Figure 13:
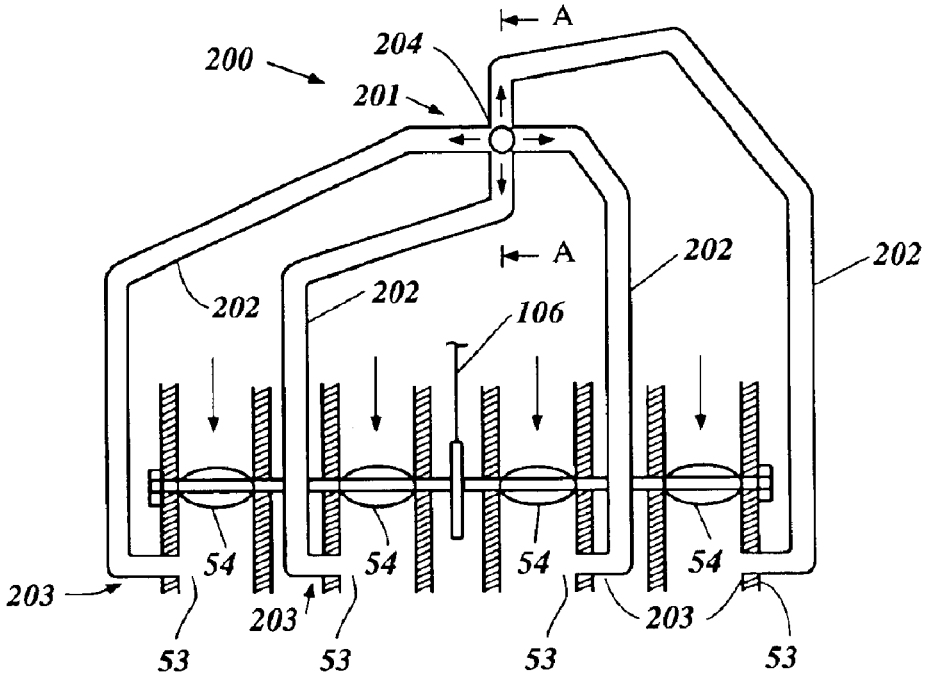
FIG. 13 is a schematic and partial cross sectional view of the engine of FIG. 3 having a modified induction system with an air bypass system.
Figure 14:
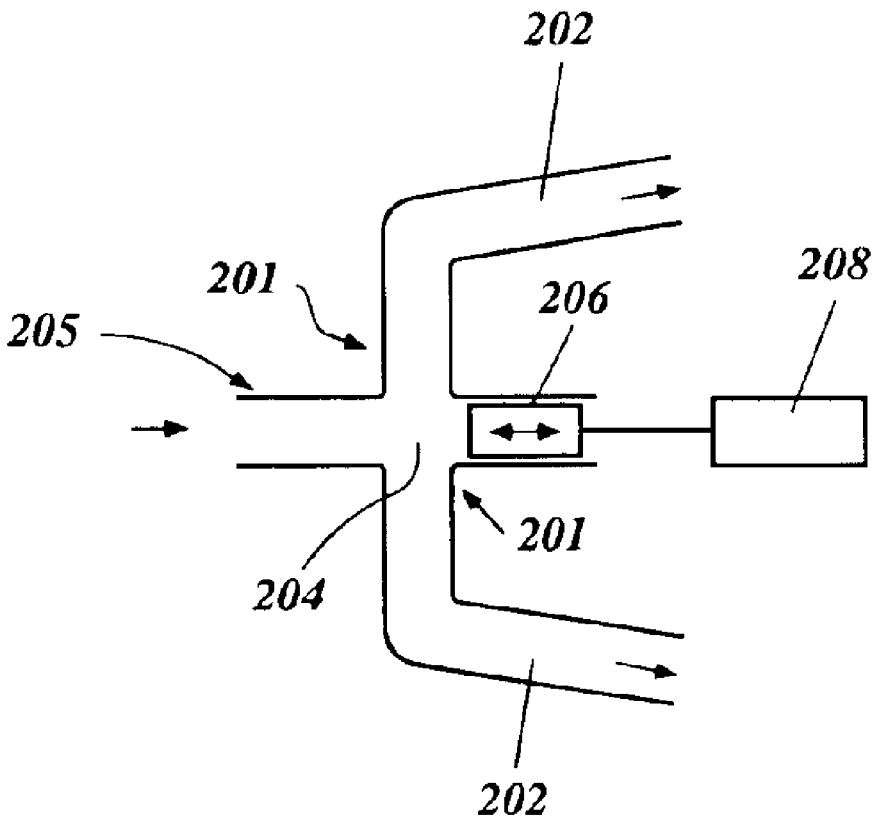
FIG. 14 is an enlarged schematic view of a portion of the air bypass system of FIG. 13.

With reference to FIGS. 12–14, a modification of the engine 32 is described therein and identified generally by the reference numeral 32'. In this modification, the engine 32' includes an auxiliary induction air supply system 200, described in greater detail below.

Figure 3:
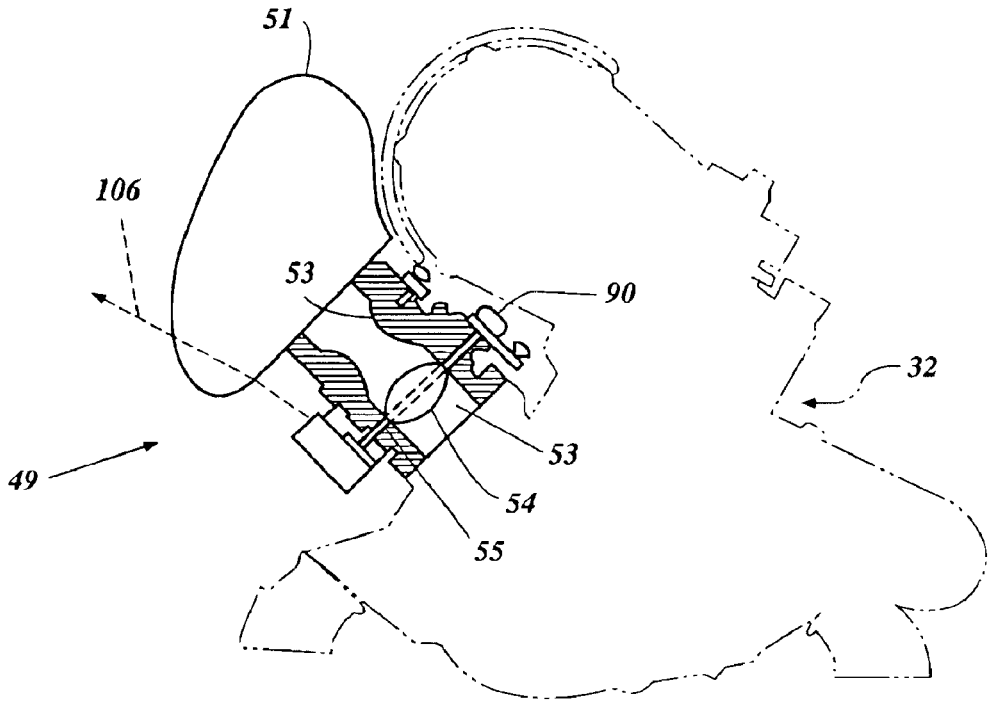
FIG. 3 is a schematic view of the engine showing the portion at which the throttle valve is disposed.

The engine 32' can be configured according to the description of the engine 32 set forth above with reference to FIGS. 1–3. Alternatively, the engine 32' can be configured to operate under the four-stroke combustion principle. As such, the induction passages 53 extend to intake ports (not shown) disposed on a cylinder head (not shown) of the engine 32'.

Induction valves (not shown) control a flow of air through the intake passages 53 into the combustion chambers of the engine 32'. Additionally, exhaust valves (not shown) disposed in the head control the flow of exhaust gases out of the combustion chambers. The remaining details regarding the construction of the engine 32' can be considered to be conventional, except as noted below.

Additionally, components of the engine 32' which are the same or similar to the components of the engine 32 described above or identified with the same reference numeral and are not described in further detail below.

In the illustrated embodiment, the engine 32' is a four-cylinder engine. Additionally, the engine 32' includes four induction passages 53, one for each cylinder. The engine 32' also includes one throttle valve 54 for each induction passage 53. However, this construction is merely exemplary, and induction systems having fewer induction passages 53 and few throttle valves 54 can also be used.

The auxiliary air system 200 includes at least one bypass passage 202 for each induction passage 53. Each of the bypass passages 202 includes an upstream end 201 which receives induction air upstream of the throttle valve 54 and a downstream end 203 connected to the induction passage 53 at a position downstream from the throttle valve 54.

In the illustrated embodiment, the induction passages 202 converge at a convergence point 204. The convergence point 204 is also connected to an auxiliary air inlet 205. The auxiliary air inlet 205 guides air, which can be drawn from an intake-silencing device (not shown) or directly from an internal cavity of the watercraft 30. The auxiliary air system 200 also includes a control valve 206 which is movably mounted relative to the convergence point 204 so as to selectively connect and disconnect the inlet 205 from the bypass passages 202.

In the illustrated embodiment, the valve 206 is connected to an actuator 208 which is configured to move the valve 206 between and open position (illustrated in FIG. 14) which allows the bypass passages 202 to communicate with the inlet 205 to the convergence point 204, and a closed position (not shown) in which the valve 206 extends into the convergence point 204 to thereby prevent air from flowing from the inlet 205 into the bypass passages 202.

A further advantage is provided where the actuator 208 can provide proportional movement of the valve 206. For example, the actuator 208 can be configured to move the valve 206 into intermediate positions within the convergence point 204 to thereby allow partial communication between the inlet 205 and the bypass passages 202. In the illustrated embodiments, the actuator 208 is a stepper motor. However, other types of actuators can be used. As shown in FIG. 12, the actuator 208 is connected to the ECU 86.

Thus, the ECU 82 can control the position of valve 206 by transmitting signals to the actuator 208. When the valve 206 is retracted to the position illustrated in FIG. 14, induction air is allowed to enter the inlet 205, pass through the convergence point 204, flow through the bypass passages 202, and flow into the induction passages 53 downstream from the throttle valves 54. Thus, the bypass passages 202 allow the engine 32' to operate at an elevated engine speed or elevated power output, greater than that which would normally correspond to a position of the throttle valves 54.

Preferably, the bypass passages 202 are sized with a sufficient capacity to provide a sufficient amount of air to the engine 32' to provide a sufficient power output to change the direction of travel of the watercraft 30 when the watercraft 30 is traveling at planing speed. A personal watercraft, such as the watercraft 30, would normally transition from a displacement mode to a planing mode at around 4,000 rpm. However, this engine speed is merely exemplary.

Figure 15:
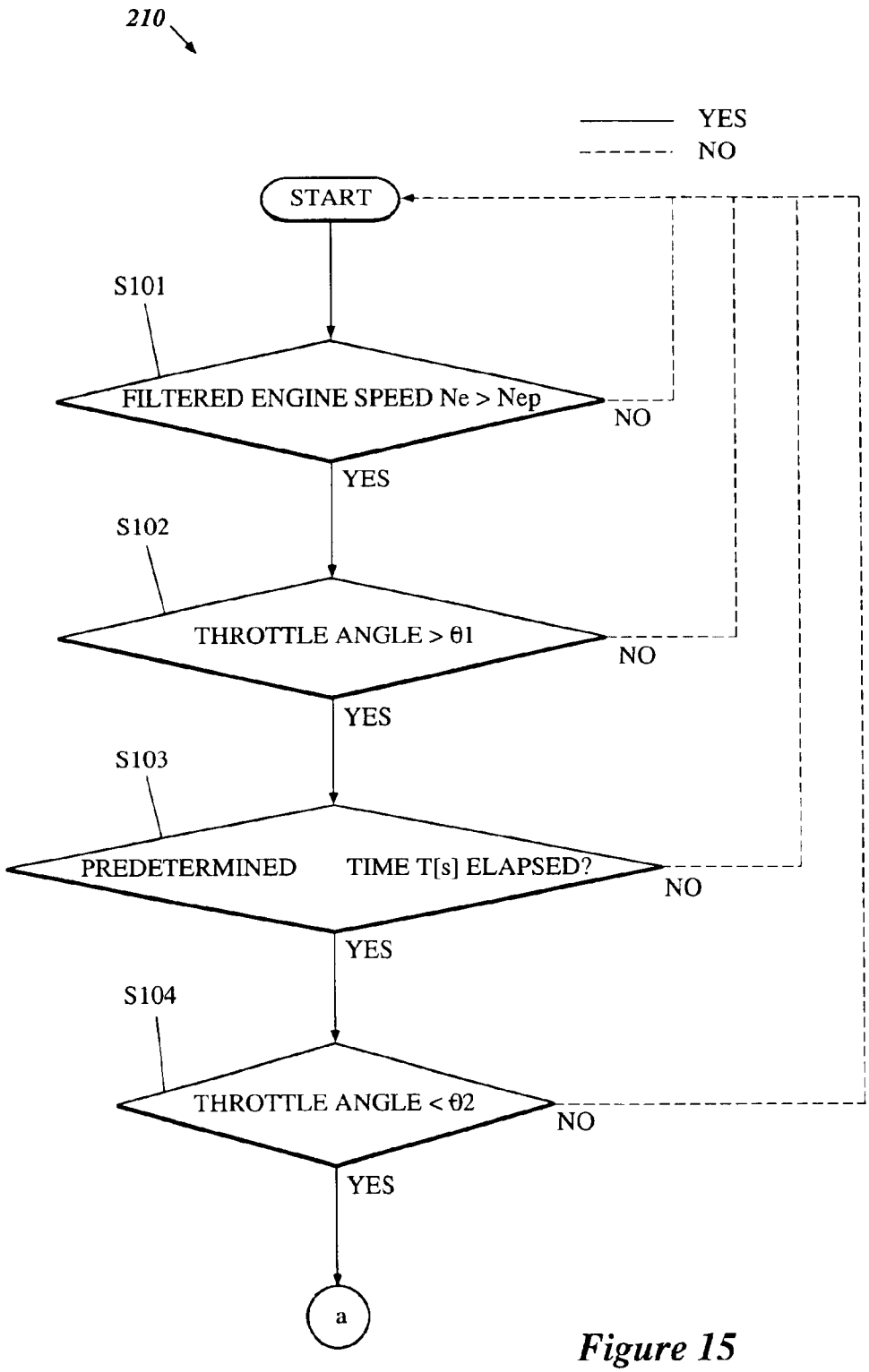
FIG. 15 is a flowchart illustrating a first portion of a control routine which can be used to control the system of FIG. 12.
Figure 16:
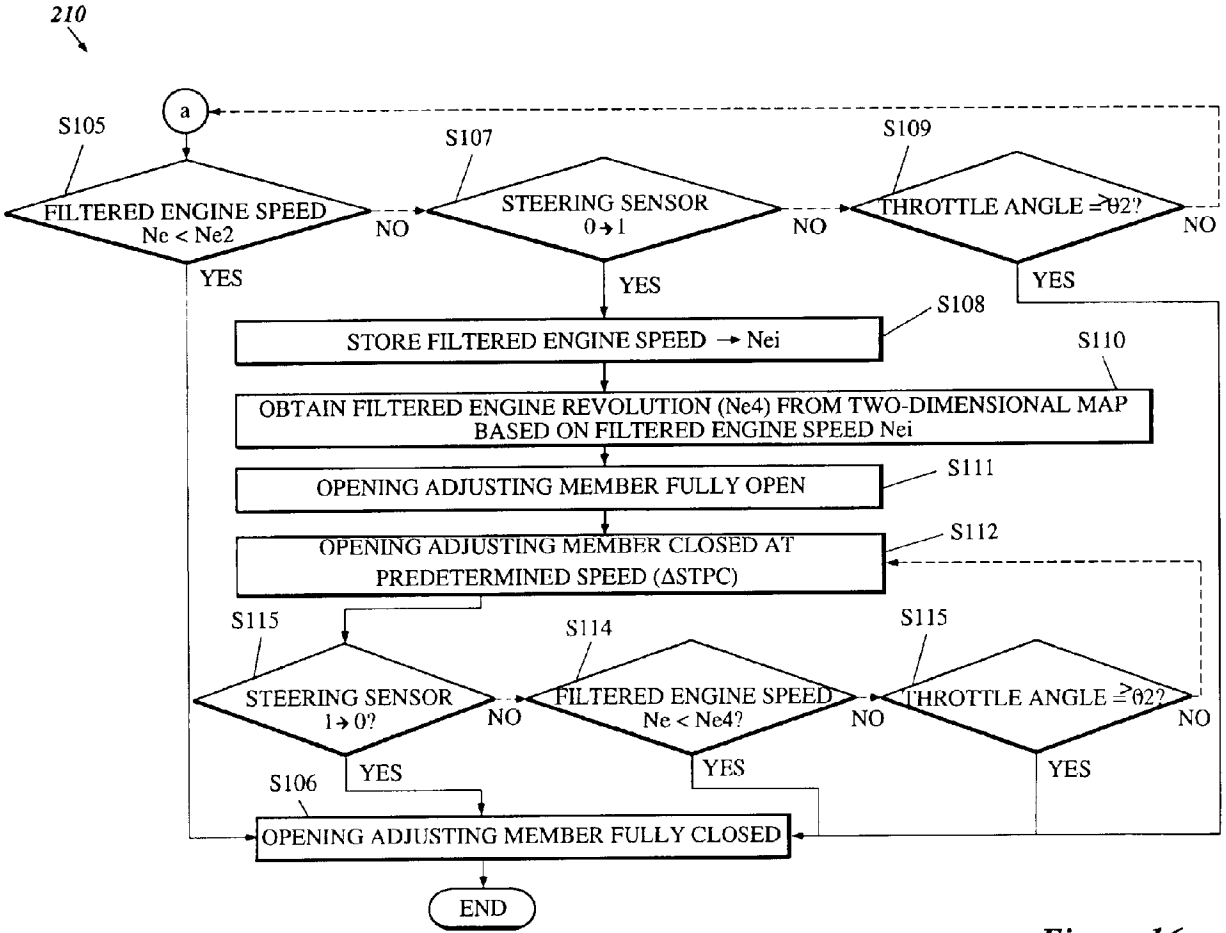
FIG. 16 is a flowchart illustrating a second portion of the control routine of FIG. 15.

With reference to FIGS. 15 and 16, a control routine 210 is illustrated therein. The control routine 210 can be used to operate the engine 32'.

The decision blocks S101, S102, and S103 can be performed in accordance with the description of the decision blocks S1, S2, and S3, respectively, described above with reference to FIG. 8. Thus, further description of the decision blocks S101, S102, and S103, is not necessary for one of ordinary skill in the art to practice the inventions disclosed herein.

After the decision block S103, the routine 210 proceeds to a decision block S104. At the decision block S104, it is determined whether a current throttle angle θ is less than a second predetermined throttle opening amount θ2. Where the routine 210 is used to control an engine, such as the engine 32', which includes an auxiliary air system, such as the auxiliary air system 200, the second predetermined throttle opening amount θ2 can be an angle that corresponds to a position in which the throttle valves 54 are nearly closed. Thus, if the throttle opening amount θ is less than the second predetermined throttle opening amount θ2, the operator of the watercraft 30 has released the throttle lever 52 and the throttle valves 54 have closed.

In the decision block S104, if it is determined that the current throttle opening amount θ is not less than the second predetermined throttle amount opening θ2, the routine 210 returns to the beginning and repeats. If, however, it is determined that the current throttle opening amount θ is less than the second predetermined throttle amount opening θ2, the routine 210 proceeds to a decision block S105 (FIG. 16).

At the decision block S105, it is determined that the current filtered engine speed Ne is less than a second predetermined filtered engine speed Ne2. The second predetermined filtered engine speed Ne2 can be a filtered engine speed that corresponds to a watercraft speed below which additional steering thrust is not desired. For example, the second predetermined filtered engine speed Ne2 can be determined, through routine experimentation, and based on the method used for determining a filtered engine speed Ne, to correspond to a watercraft speed that is sufficiently slow that additional steering thrust is not desired.

If, it is determined that the filtered engine speed Ne is less than the second predetermined filtered engine speed Ne2, the routine 210 proceeds to an operation block S106.

At the operation block S106, the provision of additional steering thrust is terminated. For example, at the operation block S106, the valve 206 can be moved to the closed position, thereby stopping the flow of air through the bypass passages 202. Thus, the speed of the engine 32' is determined by the position of the throttle valves 54.

In an embodiment of the engine 32' in which the throttle valves 54' provide an idle amount of air at the "fully closed" position, the valve 206 can be moved to a fully closed position preventing all air from flowing through the bypass passages 202. Alternatively, in an embodiment of the engine 32' in which the throttle valves 54 close the induction passages 53 completely, stopping all air from flowing pass the throttle valve 54, the valve 206 can be moved to an idle position, in which an idle amount of induction air is allowed to flow through the bypass passages 202.

With reference again to the decision block 105, if it is determined that the current filtered engine speed Ne is not less than the second predetermined filtered engine speed Ne2, the routine 210 proceeds to a decision block S107. At the decision block S107, it is determined whether the handle bar 48 has been rotated to a position which indicates that an operator desires to change the direction of travel of the watercraft 30. For example, the determination performed at the decision block S107 can be the same or similar to the operation of the decision block S10 described above with reference to FIG. 9. Thus, the determination performed at the decision block S107 is not described further. If it is determined that the handlebar 48 has been turned sufficiently to indicate that the operator does not desire to change the direction of travel of the watercraft 30, the routine 210 proceeds to a decision block S109.

At the decision block S109, it is determined whether the current throttle opening amount θ is greater than or equal to a third predetermined throttle opening amount θ2. If the current throttle opening amount θ is greater than the second predetermined throttle amount opening θ2, the operator has depressed the lever 52, thereby indicating that the operator desires to control the power output of the engine 32'. Thus, if the throttle angle θ is greater than the second predetermined throttle opening θ2, the routine 210 proceeds to the operation block S106 and terminates the provision of additional steering thrust, as described above. If, however, it is determined that the throttle angle opening amount θ is not greater than or equal to the second predetermined throttle opening amount θ2, the routine 210 returns to the decision block S105 and repeats.

With reference again to the decision block S107, if it is determined that the handlebar 48 has been turned to a position which indicates that the operator desires to change the direction of travel of the watercraft 30, the routine 210 proceeds to an operation block S108.

At the operation block S108, the current filtered engine speed Ne is saved. For example, the ECU 86 can sample the current filtered engine speed Ne and store this filtered engine speed as a reference filtered engine speed Nei in a memory portion of the ECU 86, or another memory device (not shown) external to the ECU 86. After the operation block S108, the routine 210 proceeds to an operation block S110.

At the operation block S110, a fourth predetermined filtered engine speed Ne4 is determined. For example, the fourth predetermined filtered engine speed Ne4 can be a filtered engine speed which corresponds to a watercraft velocity below which additional steering thrust is not desired. The fourth predetermined filtered engine speed Ne4 can be determined from a two-dimensional map, which can be determined through routine experimentation, and based on the method used for determining filtered engine speed. Additionally, the two-dimensional map for the fourth predetermined filtered engine speed Ne4 is also determined based on the effect on the watercraft speed provided by the remaining portion of the routine 210, described below. After the operation block S10, the routine 210 proceeds to an operation block S111.

At the operation block S111, the valve 206 is retracted to a fully opened position (e.g., schematically illustrated in FIG. 14). After the operation block S111, the routine 210 proceeds to an operation block S112.

At the operation block S112, the valve 206 is moved toward a closed position at a predetermined speed ΔSTPC. As such, the filtered engine speed Ne continues to fall at a rate similar to that provided by the fall in filtered engine speed Ne provided by the operation block S11, described above with reference to FIG. 9. After the operation block S112, the routine 210 proceeds to a decision block S113.

At the decision block S113, it is determined whether the handlebar 48 has been turned to a position indicating that an operator no longer desires to change the direction of travel of the watercraft 30. For example, the determination performed in the decision block S113 can be the same or similar to that performed in the decision block S113, described above with reference to FIG. 9. If the determination of the decision block S113 is affirmative, the routine proceeds to the operation block 106, described above. However, if the determination of the decision block S113 is negative, the routine 210 proceeds to a decision block S114.

At the decision block S114, it is determined whether the current filtered engine speed Ne is less than the fourth predetermined filtered engine speed Ne4. If it is determined that the current filtered engine speed Ne is less than the fourth predetermined filtered engine speed Ne4, the routine 210 proceeds to the operation block S106, described above. However, if it is determined that the filtered engine speed Ne is not less than the fourth predetermined filtered engine speed Ne4, the routine 210 proceeds to an decision block S115.

At the decision block S115, it is determined whether the current throttle opening amount θ is greater than or equal to the second predetermined throttle opening amount θ2. If it is determined that the current throttle opening amount θ is not greater than or equal to the second predetermined throttle opening amount θ2, the routine 210 returns to the operation block S112 and repeats. However, if it is determined that the current throttle opening amount θ is not greater than or equal to the second predetermined throttle opening amount θ2, the routine 210 proceeds to the operation block S106, described above.

Following the operation block S106, the routine 210 can end, or can return to the start illustrated in FIG. 15.

Figure 17:
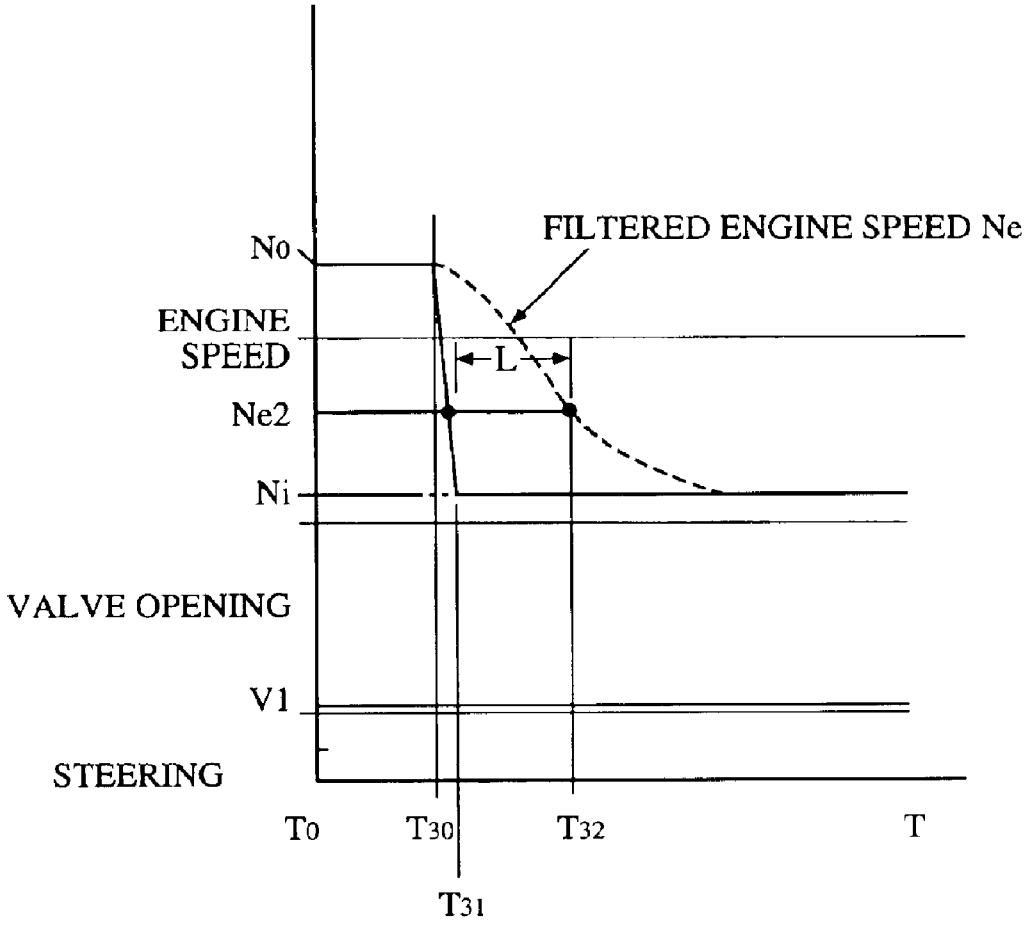
FIG. 17 schematically illustrates an exemplary operation of the control system of FIG. 12 in which the lateral axis represents the time and the vertical axis represents the filtered engine speed and the inputs and outputs of the control system.

With reference to FIG. 17, an exemplary operation of the engine 32' is described below. As shown in FIG. 17, at time T0, the engine 32' is operating at an initial engine speed N0. Additionally, the engine 32' has operated at the engine speed N0 for sufficient time such that the determinations performed in decision blocks S101, S102, and S103 are all affirmative.

At time T30, although not illustrated in FIG. 17, an operator releases the throttle lever 52, thereby allowing the throttle valves 54 to close at an uncontrolled speed. Thus, at approximately the time T30, an affirmative result is achieved in the decision block S104. The engine speed N then falls to an idle engine speed Ni.

As shown in FIG. 17, the handlebar is not moved to a position indicating that an operator desires to change the direction of travel of the watercraft 30. Thus, between the time periods T30 and T32, the routine 210 repeatedly proceeds through decision blocks S105, S107, and S109.

Additionally, as noted above, the opening amount of the valve 206 is indicated as having a slightly positive value V1. This can correspond to an arrangement of the engine 32' in which the throttle valves 54 completely close the induction passage 53 in their "fully closed" position, thereby preventing a sufficient amount of air from passing through the induction passage 53 to maintain the engine 32' in an idling state of operation. Thus, when the throttle valves 54 are in a fully closed position, the valve 206 is positioned in a partially open position V1 to maintain the engine 32' in an idling operation state. However, as noted above, the routine 210 can be used with an arrangement of the engine 32' in which when the throttle valve 54 are in a fully closed position, a sufficient amount of air can flow pass the throttle valves 54 to allow the engine to maintain an idle operation state. In this arrangement, the fully closed position of the valve 206 can correspond to a position in which the valve 206 completely stops all air from flowing from the inlet 205 to the bypass passages 202. Alternatively, the engine 32' can be configured such that a small amount of air can flow pass to the throttle valves 54 in a fully closed position and a small amount of air can flow pass the valve 206 in a fully closed position thereof.

With continued reference to FIG. 17, the filtered engine speed Ne falls to the second predetermined filtered engine speed Ne2 at a time T32. Thus, a time T32, an affirmative result is obtained at the decision block S105. At the time T32, the routine 210 moves to the operation block S106 to return the valve 206 to a fully closed position. However, during the exemplary operation illustrated in FIG. 17, the valve 206 remained in the fully closed position V1 throughout the duration of this exemplary operation.

Figure 18:
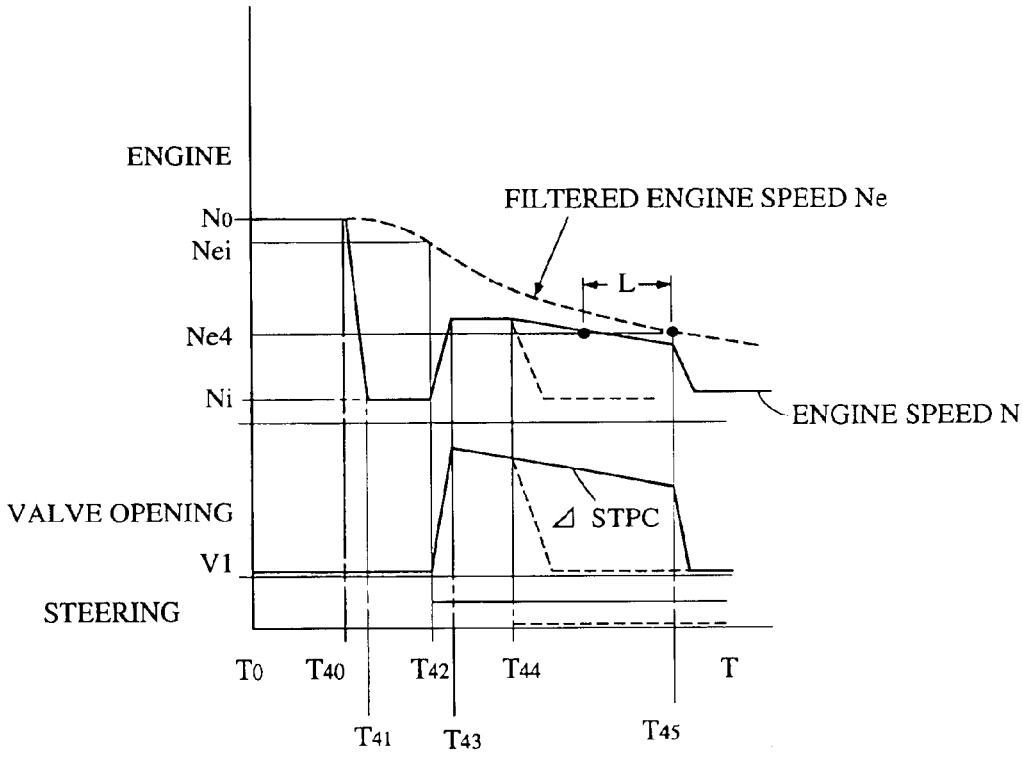
FIG. 18 schematically illustrates another exemplary operation of the control system of FIG. 12, in which the lateral axis represents the time and the vertical axis represents the filtered engine speed and the inputs and outputs of the control system.

FIG. 18 illustrates another exemplary operation of the engine 32' during the operation of the routine 210. As shown in FIG. 18, at time T0, the engine speed is initially N0 and is sufficiently high for sufficient time period such that the determinations in decision blocks S101, S102, and S103 are positive.

At the time T40, the operator has released the throttle lever 52, thereby allowing the throttle valve opening amount θ to fall below the second predetermined throttle opening amount θ2. Thus, at a time in the vicinity of time T40, an affirmative result is attained in the decision block S104. In the exemplary operation of FIG. 18, the engine speed drops abruptly through an idle engine speed Ni at a time T41. Additionally, the handlebar 48 is not moved to a position indicating a desire to change the direction of travel of the watercraft 30 between the time T40 and T42. Thus, the routine 210 repeatedly proceeds through decision block S105, S107, and S109.

At the time T42, the handlebar 48 is turned to a position indicating a desire to change the direction of travel of the watercraft 30. Thus, the graph of FIG. 18 indicates that an affirmative result is achieved in the decision block S107 at time T42. At the time T42, a current filtered engine speed Ne is saved as an "initial" filtered engine speed Nei (operation block S108). Additionally, at the time T42, a fourth predetermined filtered engine speed Ne4 is determined from predetermined data (operation block S110). Further, at the time T42, the valve 206 is retracted toward an open position, resulting in a fully open position at time T43. Thus, at about the time T43, the engine speed N rises to a speed providing additional steering thrust sufficient to change the direction of travel of the watercraft 30 (operation block S111). Additionally, at the time T43, the valve 206 is moved toward a closed position at the predetermined speed ΔSTPC.

The solid line representation of the steering sensor output in FIG. 18 shows that the handlebar 48 is maintained in a position indicating a desire to change the direction of travel to watercraft 30. Thus, between the time periods T43 and T45, the valve 206 continues to be moved toward a closed position at the speed ΔSTPC. The routine 210 then repeatedly proceeds through the decision blocks S113, S114, S115, and the operation block S112.

At the time T45, the filtered engine speed Ne falls below the fourth predetermined filtered engine speed Ne4, thereby causing an affirmative result in the decision block S114. Therefore, at the time T45, the valve 206 is moved to the fully closed position, thereby allowing the engine speed N to fall to an idle engine speed Ni (operation block S106).

An alternative scenario is illustrated in FIG. 118 in which the handlebar 48 is moved (shown in dashed line) to a position indicating that a change of direction of travel of the watercraft 30 is not desired, at a time T44. Thus, at the time T44, an affirmative result is achieved in the operation block S113 (FIG. 16). The routine 210 then proceeds to the operation block S106, thereby causing the valve 206 to be moved to the fully closed position V1.

In the aforementioned embodiments, the engine speed control has been applied to a four-cycle engine and a two cycle engine. The engine speed control should not be limited to those engine types and can be applied to other powering systems such as, for example, diesel engines, natural gas, nuclear reaction, and electric motors.

In the aforementioned embodiments, the engine speed control is performed by delaying the return speed of the throttle valve 54, or by providing auxiliary air into the air intake passages 53. However, it is not limited thereto, and the engine speed control can be performed by adjusting the ignition timing or the fuel injection timing or the like.

Though the returning speed of the throttle valve 54 is delayed by using the push pin 112 of the stepper motor 110, it is not limited thereto, and the returning speed of the throttle valve 54 can be controlled by any means that could resist the uncontrolled rate of return as dictated by the spring urging the throttle valve 54 closed.

Another advantage that can be achieved by determining a modified engine speed value is related to over-revving prevention. As is known in the art, internal combustion engines can be damaged if allowed to reach a speed above the maximum rated speed for the engine.

One circumstance in which an engine can reach an excessive speed is when the engine is operating under load, and the load is suddenly reduced. The situation can occur in a watercraft, for example, when the watercraft is being operated under load on a body of water, and the watercraft jumps out of the water. In this situation, when the watercraft leaves the body of water, the load on the propulsion unit is suddenly removed, allowing the engine to accelerate abruptly, which can result in an engine speed above the maximum rated engine speed for the engine.

Another circumstance in which an engine can reach an excessive speed is when the engine is operated without load and under a full throttle condition. For example, certain maintenance procedures for maintaining a watercraft require the engine of the watercraft to be operated while the watercraft is not in the water. Thus, if the engine of the watercraft is operated a full throttle when the watercraft is not in water, the engine speed can rise sufficiently abruptly that the engine speed of rises above the maximum rated engine speed of the engine. Additionally, many watercraft include open-loop cooling systems which draw water from the body of water which the watercraft normally operates, and circulate this water through the engine for cooling purposes. However, when the watercraft is operated out of the water, no cooling water is circulated through the engine. As such, it is more risky to operate such a watercraft engine at high speed while the watercraft is out of the water.

As noted above, another aspect of the least one of the inventions disclosed herein includes the realization that a comparison of a modified engine speed value and an actual engine speed value can be used as an indication that the watercraft is not being operated in water. For example, as is also noted above, a modified engine speed value can be configured to change more slowly than an actual engine speed value. Additionally, such a modified engine speed can be configured to change approximately proportionally to the corresponding watercraft speed, when the watercraft is operating normally in a body of water. Under such normal operation, the engine is loaded, which causes the engine to change speed more slowly than when the engine is completely unloaded, e.g. when the watercraft is out of the water.

When such a modified engine speed value is compared to the actual engine speed, and when the watercraft is operating normally in water, at least one relationship becomes apparent. For example, the ratio of the actual engine speed to the modified engine speed value, during acceleration, remains below a threshold value. In exemplary embodiment, the actual engine speed N can be divided by the filtered engine speed Ne (determined in accordance with any of the methods described above) to produce an actual-to-filtered engine speed ratio (N/Ne). It has been found that, under normal operation, the actual-to-filtered engine speed ratio (N/Ne) remains below a threshold value during acceleration. However, when the engine 32, 32', is operated out of the water, thereby removing the load provided by the body of water in which the watercraft normally operates, the engine 32, 32', accelerates more quickly. As such, the actual-to-filtered engine speed ratio (N/Ne) can exceed the threshold value during acceleration.

Thus, in accordance with yet another aspect of the least one of the inventions disclosed herein, the control system 34 can be configured to determine a ratio of an actual engine speed to a modified engine speed value, and to compare this ratio to predetermined value. For example, but without limitation, the control system 34 can be configured to determine an actual-to-filtered engine speed ratio (N/Ne), and to determine if the ratio is less than a predetermined threshold AFR. Additionally, the control system 34 can be configured to reduce the output of the engine 32, 32' if the actual-to-filtered engine speed ratio (N/Ne) is less than the predetermined threshold AFR. For example, the control system 34 can be configured to adjust ignition timing, disable cylinders through ignition or fuel injection manipulation, manipulation of the throttle valves 54, or any other known method for controlling the output of an engine, so as to reduce the power output of the engine or limit the speed of the engine to below a predetermined actual engine speed Nu. Optionally, the predetermined actual engine speed Nu can be an engine speed that is lower than the engine speed used as a rev-limit threshold during normal operation of the watercraft 30.

This operation of can optionally be incorporated into either of the control routines 115, 210 described above. Alternatively, the above operation can be incorporated into another separate control routine or control module (not shown).

Accordingly, the foregoing description is that of preferred embodiments of the present invention, and various changes and modifications maybe made without departing from the spirit and scope of the invention, as defined by the appended claims.

What is claimed is:

1. A watercraft comprising a hull, an engine supported by the hull, a propulsion request device configured to allow an operator to input a propulsion request, a propulsion device supported by the hull and being driven by the engine, an engine speed sensor configured to detect an actual speed of the engine, a controller configured to communicate with the propulsion request device and to affect a power output of the engine based on an output of the propulsion request device and a speed of the engine, the controller being configured to determine an actual engine speed value of the engine based on the output of the engine speed sensor and a modified engine speed value, based on the output of the engine speed sensor, and the modified engine speed value being configured to change more slowly than the actual speed of the engine, the controller being further configured to maintain the power output of the engine at magnitudes above a magnitude of power output corresponding to the output of the propulsion request device, until the modified engine speed falls below a predetermined value.

2. The watercraft according to claim 1, wherein the controller is also configured to change a power output of the engine based on the modified engine speed value.

3. A watercraft comprising a hull, an engine supported by the hull, a propulsion request device configured to allow an operator to input a propulsion request, a propulsion device supported by the hull and being driven by the engine, an engine speed sensor configured to detect an actual speed of the engine, a controller configured to communicate with the propulsion request device and to affect a power output of the engine based on an output of the propulsion request device and a speed of the engine, the controller being configured to determine an actual engine speed value of the engine based on the output of the engine speed sensor and a modified engine speed value, based on the output of the engine speed sensor, and the modified engine speed value being configured to change more slowly than the actual speed of the engine, wherein the modified engine speed value is configured to be more in proportion to a speed of the watercraft, than the actual engine speed, when the watercraft is operating in a body of water.

4. A watercraft comprising a hull, an engine supported by the hull, a propulsion request device configured to allow an operator to input a propulsion request, a propulsion device supported by the hull and being driven by the engine, an engine speed sensor configured to detect an actual speed of the engine, a controller configured to communicate with the propulsion request device and to affect a power output of the engine based on an output of the propulsion request device and a speed of the engine, the controller being configured to determine an actual engine speed value of the engine based on the output of the engine speed sensor and a modified engine speed value, based on the output of the engine speed sensor, and the modified engine speed value being configured to change more slowly than the actual speed of the engine, wherein the controller is configured to determine the modified engine speed by averaging engine speeds detected by the engine speed sensor.

5. The watercraft according to claim 4, wherein the controller is configured to average actual engine speeds using a simple moving average method.

6. The watercraft according to claim 4, wherein the controller is configured to average actual engine speeds using a weighted moving average method.

7. The watercraft according to claim 4, wherein the controller is configured to average actual engine speeds using an exponential moving average method.

8. A watercraft comprising a hull, an engine supported by the hull, a propulsion request device configured to allow an operator to input a propulsion request, a propulsion device supported by the hull and being driven by the engine, an engine speed sensor configured to detect an actual speed of the engine, a controller configured to communicate with the propulsion request device and to affect a power output of the engine based on an output of the propulsion request device and a speed of the engine, the controller being configured to determine an actual engine speed value of the engine based on the output of the engine speed sensor and a modified engine speed value, based on the output of the engine speed sensor, and the modified engine speed value being configured to change more slowly than the actual speed of the engine, additionally comprising a steering mechanism configured to allow an operator to change a direction of travel of the watercraft, a steering mechanism sensor connected to the controller and configured to detect the position of the steering mechanism, wherein the controller is configured to slow the engine speed at a first rate that is slower than an uncontrolled speed reduction rate of the engine when the propulsion request device outputs a minimum propulsion request and the steering mechanism is not moved to the position indicating that the operator intends to change the direction of travel the watercraft, and to slow the engine speed at a second rate that is slower than the first rate when the steering mechanism is moved to a position indicating that the operator intends to change the direction of travel the watercraft.

9. A watercraft comprising a hull, an engine supported by the hull, a propulsion request device configured to allow an operator to input a propulsion request, a propulsion device supported by the hull and being driven by the engine, an engine speed sensor configured to detect an actual speed of the engine, a controller configured to communicate with the propulsion request device and to affect a power output of the engine based on an output of the propulsion request device and a speed of the engine, the controller being configured to determine an actual engine speed value of the engine based on the output of the engine speed sensor and a modified engine speed value, based on the output of the engine speed sensor, and the modified engine speed value being configured to change more slowly than the actual speed of the engine, additionally comprising a throttle valve, a spring configured to bias the throttle valve toward a closed position, and an actuator configured to slow the closing of the throttle valve based on the modified engine speed value.

10. A method of controlling an engine of a watercraft comprising detecting a propulsion request from an operator of the watercraft, detecting an actual speed of the engine, controlling a power output of the engine based on the detected actual speed of the engine and based on the propulsion request, determining a modified engine speed value such that the modified engine speed value changes more slowly than the detected engine speed, and maintaining the power output of the engine at magnitudes above a magnitude of power output corresponding the propulsion request, until the modified engine speed value falls below a predetermined value.

11. The method according to claim 10 additionally comprising detecting a steering angle of the watercraft, and operating the engine at a power output level greater than that corresponding to the propulsion request if the steering angle indicates that an operator of the watercraft intends to change the direction of travel of the watercraft.

12. A method of controlling an engine of a watercraft comprising detecting a propulsion request from an operator of the watercraft, detecting an actual speed of the engine, controlling a power output of the engine based on the detected actual speed of the engine and based on the propulsion request, determining a modified engine speed value such that the modified engine speed value changes more slowly than the detected engine speed, additionally comprising determining if the propulsion request has changed abruptly from an elevated value to a minimum value, determining if an operator of the watercraft intends to change the direction of travel of the watercraft, lowering the engine speed at a first rate less than that corresponding to the abrupt change of the propulsion request if the operator does not intend to change the direction of travel of the watercraft, and lowering the speed of the engine at a second rate, less than the first rate, if the operator does intend to change the direction of travel of the watercraft.

13. The method according to claim 12 wherein determining a modified engine speed value comprises modifying the actual engine speed such that the modified engine speed value is more in proportion, than the detected actual engine speed, to a speed of the watercraft when operating normally on a body of water.

14. A method of controlling an engine of a watercraft comprising detecting a propulsion request from an operator of the watercraft, detecting an actual speed of the engine, controlling a power output of the engine based on the detected actual speed of the engine and based on the propulsion request, determining a modified engine speed value such that the modified engine speed value changes more slowly than the detected engine speed, additionally comprising limiting the speed of the engine to a maximum engine speed, determining a ratio of the actual engine speed to the modified engine speed, and lowering the maximum engine speed if the ratio is larger than a predetermined value.

15. A watercraft comprising a hull, an engine supported by the hull, a propulsion request device configured to allow an operator to input a propulsion request and configured to emit a propulsion request output, a controller configured to determine a modified engine speed value and to determine if the propulsion request output changes abruptly from a first value to a second lower value, the controller being configured to lower the engine speed at a first rate slower than a rate at which the propulsion request output abruptly changed, the watercraft also including a steering mechanism, and a steering sensor connected to the controller, the controller being further configured to lower the engine speed at a second rate that is lower than the first rate until the modified engine speed value falls below a predetermined value.

16. A watercraft comprising a hull, an engine supported by the hull, a propulsion request device configured to allow an operator to input a propulsion request and configured to emit a propulsion request output, a controller configured to determine if the propulsion request output changes abruptly from a first value to a second lower value, the controller being configured to lower the engine speed at a first rate slower than a rate at which the propulsion request output abruptly changed, the watercraft also including a steering mechanism, and a steering sensor connected to the controller, the controller being further configured to lower the engine speed at a second rate that is lower than the first rate, additionally comprising a throttle valve biased toward a closed position with a spring configured to close the throttle valve at an uncontrolled speed, the first and second rates being slower than the uncontrolled speed.

17. The watercraft according to claim 16 additionally comprising an air bypass system configured to guide through a bypass passage around the throttle valve and a bypass valve disposed in the bypass passage configured to meter an amount of air flowing through the bypass passage, the controller being configured to control the bypass valve so as to lower the engine speed at the first and second rates.

18. A watercraft comprising a hull, an engine supported by the hull, a propulsion input device configured to allow an operator to direct a propulsion request to the engine, a propulsion device supported by the hull and being driven by the engine, a controller configured to affect a power output of the engine, a sensor configured to detect a speed of the engine, a steering mechanism configured to allow an operator of the watercraft to change a direction of travel of the watercraft, a sensor configured to detect a position of the steering mechanism, the controller being configured to increase a power output of the engine to an elevated power output level that is beyond a power output corresponding to the output of the propulsion request input device if the steering mechanism is moved to a position indicating an operator's desire to change a direction of travel of the watercraft, the controller also being configured to terminate the increase in power output after a delay after the engine speed falls below a predetermined engine speed.

19. The watercraft according to claim 18, wherein the controller is configured to generate the delay based on a mathematical operation on the detected engine speed.

20. The watercraft according to claim 18, wherein the controller is configured to generate the delay based on a moving average of the detected engine speed.

21. The watercraft according to claim 18, wherein the position indicating the operators desire to change a direction of travel of the watercraft corresponds to an angular position of the steering mechanism beyond a predetermined angular position.

22. A method of providing additional steering force for a watercraft comprising detecting a propulsion request from an operator of the watercraft, detecting a steering direction request from the operator of the watercraft, detecting a speed of an engine of the watercraft, increasing a power output of the engine to an elevated power output level that is greater than the power output level corresponding to the propulsion request, returning the power output of the engine to the level corresponding to the propulsion request after a delay after the engine speed falls below a predetermined engine speed value.

23. The method according to claim 22, wherein returning the power output comprises calculating an average engine speed and returning the power output of the engine to the level corresponding to the propulsion request after the average engine speed falls below a predetermined average engine speed.

24. The method according to claim 23, wherein calculating an average engine speed comprises calculating a moving average of the engine speed.

25. The method according to claim 23, wherein calculating an average engine speed comprises calculating a weighted moving average engine speed.

26. The method according to claim 23, wherein calculating an average engine speed comprises calculating an exponential moving average of the engine speed.

* * * * *